US005402948A

United States Patent [19]

Kaczmarek

[11] Patent Number: 5,402,948

[45] Date of Patent: Apr. 4, 1995

[54] COMMINUTING DEVICE WITH FACE

[76] Inventor: Al Kaczmarek, 136 S. Commercial Ave., Wood Dale, Ill. 60191-1304

[21] Appl. No.: 98,455

[22] Filed: Apr. 30, 1993

[51] Int. Cl.[6] ..... B02C 13/284

[52] U.S. Cl. ..... 241/73; 241/196.2; 241/239

[58] Field of Search ..... 241/73, 186.2, 186.4, 241/224, 239, 292.1, 294

[56] References Cited

U.S. PATENT DOCUMENTS 5,150,844 9/1992 McKie ..... 241/73

*Primary Examiner*—Douglas D. Watts

*Attorney, Agent, or Firm*—Michael R. McKenna

[57] ABSTRACT

This invention relates to a comminuting device which processes small pieces of bulk materials, such as pieces of rubber tires, into crumb-sized particles. It is designed to operate at slow speeds, 50–350 rpm by having the work material move along the exterior peripheral surface of a rotating drum cutting efficiencies are improved. This unique invention provides cutting teeth on the stator and drum each having limited rotational movement which permits greater efficiency for cutting multi-grade materials such as rubber tires having steel and material cord. Cutting blades can be rotated three times to expose unused cutting edges before replacement is required.

21 Claims, 6 Drawing Sheets

134
139
135
141
137
136
154b
154
132
74e
74f
154
154b
70
73
73a
127
127a
144
115
54
5
9
9
24
66
7
118
5
7
118
70
66
114a
144
114
73n
9
5
7
155b
155
147
145
109
155
155b
107
105
141
38
74
101
102

8
8
9
9
67
67a
70
69a
66d
67a
67
66e
66c
66a
66
66b
68c
68
69a
68b
73b
68c
73a
68a
71a
70
100
5
5b
5e
7e
7
7d
7b
5b
5c
116a
11a
15
9a
9
13
15a
7c
11
13b
13a
116
115
9
116a
15a
115
17a

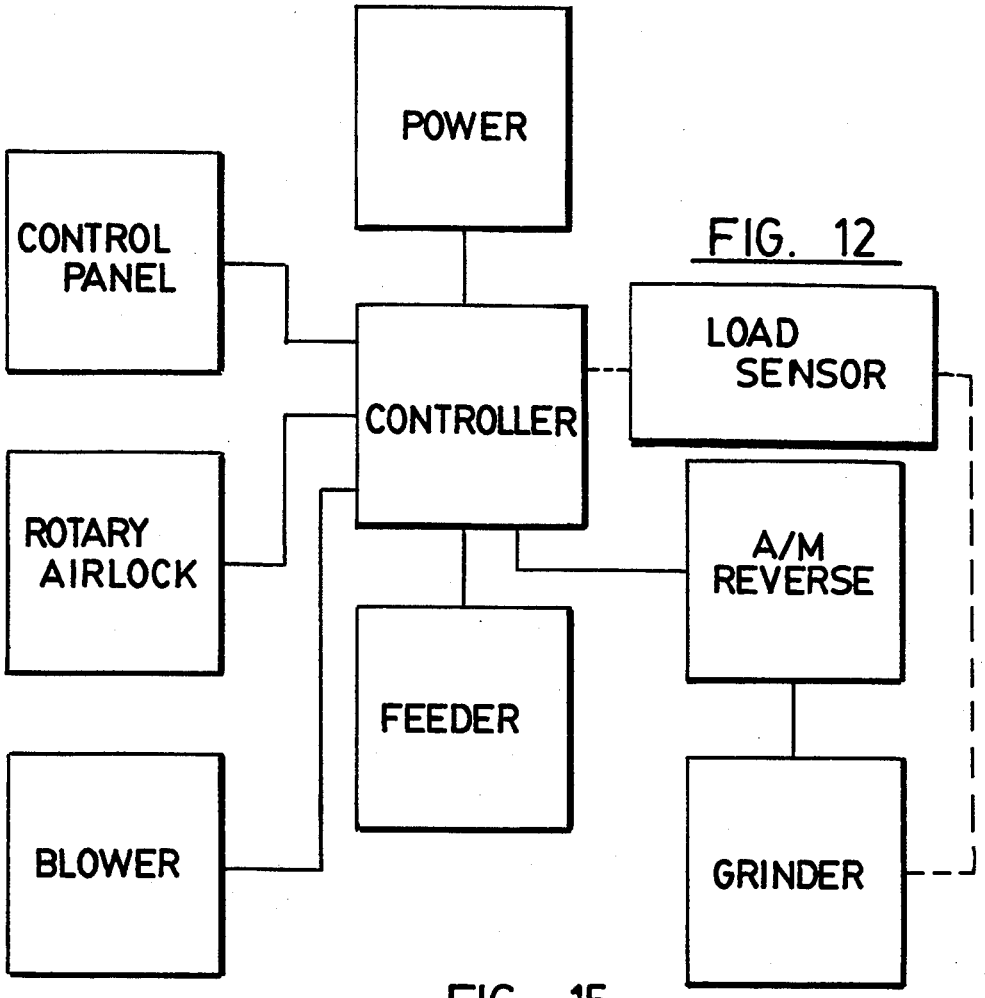
FIG. 12
FIG. 15
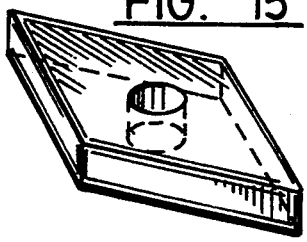
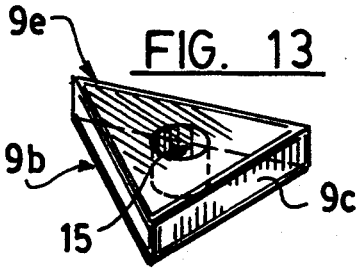
FIG. 13
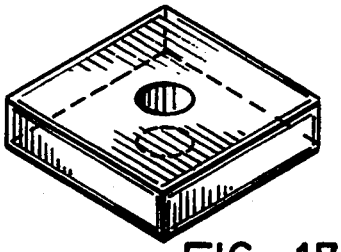
FIG. 17
FIG. 16
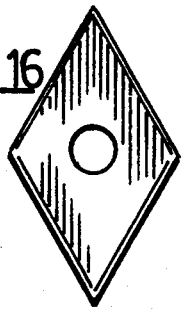
FIG. 14
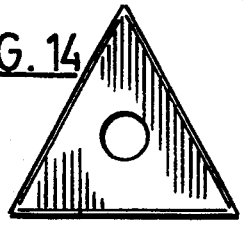
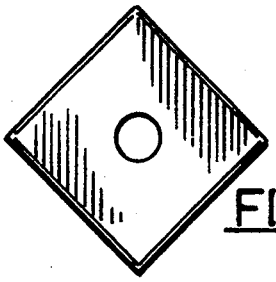
FIG. 18

COMMINUTING DEVICE WITH FACE

This application is a continuation-in-part of prior application Number PCT/U.S.93/0155, filed on Feb. 19, 1993.

BACKGROUND OF THE INVENTION

The background of this invention relates to various shredding, tearing, cutting and grinding devices which process small pieces of bulk materials, such as pieces of rubber tires, into crumb-sized particles. Shredding devices are generally known which process large pieces of bulk materials.

An early patent issued to Klagsbrunn, U.S. Pat. No. 2,546,860, teaches a high speed centrifugal mill having a rotating drum having a sieve disposed on its peripheral edge with grinding tools disposed in said drum. It was used for grinding corn. Each tool disclosed had a three-edged profile and a helical pitch which allowed the mill to operate more smoothly because the striking surfaces of the centrifugal tool members did not operate along their entire length at the same moment.

U.S. Pat. No. 4,394,983, issued to Ulsky for a tire shredder assembly, has a stationary rack in opposition to a rotary cutting assembly. This device is specifically for the purpose of reducing tires to small pieces or chunks with a minimum production of fines and powdery material.

The Ehrlick et al. device, U.S. Pat. No. 3,561,303, employs a series of reciprocating or oscillating knives which co-act with a stationary anvil to shear tire moving across the anvil into diamond-shaped particles. A later patent issued to Ehrlick et al., U.S. Pat. No. 4,052,013, relates to a tire shredding device employing a pair of side-by-side parallel and generally cylindrical shredding drums, said drum defined by a series of axially spaced apart circular cutting disks.

U.S. Pat. No. 4,520,963, issued to Grebe et al., discloses a method for continuously cutting materials such as tires employs a centrifugal technique with fast rotating knives.

U.S. Pat. No. 4,714,201 issued to Rouse et al. teaches an apparatus and method for used tire processing including a method for monitoring the electrical load on the dram motor to reduce overloads. Reference therein is made to a plastics granulator manufactured by the Cumberland Engineering Company, a division of Leesona Corporation. Leesona is the assignee of numerous U.S. Patents including the following. U.S. Pat. Nos. 3,960,334; 4,106,708; 4,171,778; and 4,206,882. U.S. Pat. No. 3,960,334 relates to a size reduction apparatus having cutting means disposed laterally on a plurality of rotor plates and cooperating bed knives. The design for the cutting means disposed laterally on a plurality of rotor plates and plates are disclosed respectively in U.S. Pat. Nos. 4,106,708 and 4,206,882. U.S. Pat. No. 4,171,778, discloses the granulator rotor comprising a longitudinally oriented shaft having at least a plurality of longitudinally spaced plates that have a plurality of corners, said plates extending radially outwardly from said shaft so as to define a plurality of open box-like material receiving pockets.

Of further note are two foreign patents from the Soviet Union. Soviet Union Patent Number SU 1444–158A discloses a worn-out tire grinder for rubber reclamation having a driven cutting rotor plus fixed knives and springloaded grating for production of rubber crumb. The blade design is shown in FIG. 7. Soviet Union Patent Number SU 937–255 discloses a tire shredder for reclamation having a unique slicing knife (7) (powered rotor with exchangeable pins) and a secondary shredding rotor (15) which is not detailed in the drawing and presumably of known design.

The principal disadvantages are that the devices above fail to provide a suitable device for handling multi-grade material comminuting applications without frequent downtime resulting from jamming and time lost for replacement of cutting means. High speed centrifugal mills create these maintenance difficulties, consume considerable power and wear. Multi-shaft devices necessarily develop sizeable clearances to accommodate differences in expansion.

ADVANTAGE OF THIS INVENTION

An advantage of this invention is that it designed to operate at a relatively slow speed, 50–350 rpm. By having the work material move along the peripheral surface of the drum, high speed centrifugal mode is not required. Because the cutting takes place at the peripheral edge of the drum, drum rotational speed can be reduced effectively to the range of 50–350 rpm. Less waste heat and distortion is created and the cutting efficiencies is improved. This unique design offers minimal tolerances and thus increased efficiency in producing small mesh output.

In the present application of the embodiments of this invention, it is desired to grind material which is tough, difficult to grind, and comprised on more than one material. The cutting assembly design of this beneficial invention further provides for a unique elongated holder means. Designed to have its outwardly disposed face form a portion of the peripheral surface of the drum, it adds axial strength to the cylindrically walled rotary grinding drum while securing the teeth therein. In a preferred embodiment of the present invention, interpolative cutting teeth of the stator and drum each possesses limited rotational movement about their respective securing pins. Such movement permits greater flexibility for the cutting surfaces in dealing with multi-grade materials such as rubber tires having steel and material cord. This cutting flexibility reduces the impact force experienced by each cutting tip and allows the teeth to strip coatings off of steel belted cord passing vertically between interpolative cutting teeth and to cut a like material passing horizontally between interpolative cutting teeth and further to flexibly cut, shred, tear and grind the various work materials flowing through any of the preferred embodiments of this invention.

Another advantage of this invention is that it employs only one rotating grinding drum. In a preferred embodiment, stationary cutting assemblies are presented on the drum housing where minimal axial expansion results. Due to the closer clearances between the drum teeth and the stator teeth, the action is primarily a cutting action although shearing, tearing, grinding, and ripping action occurs. The clearances between interpolative teeth on the drum and stator is small, so that the cutting edges co-act to shear material fed into the space therebetween.

Further advantages are the oblique angle of the drum cutting teeth relative to the stationary cutting teeth implies a positive rake angle, which reduces shear strain, forces, power consumption, waste heat creation, and increases tool life. One preferred embodiment of the invention provides for positioning the drum teeth such that only one interpolative cutting edge interpolatively engages a stator cutting tooth at any moment during rotation with a further reduction in shear strain, forces and power consumption.

Since in a preferred embodiment the stationary teeth are offset relative to each other, two different edges of a drum cutting tool are used, one for interpolating with a tooth on each of the stator cutting teeth, increased cutting edge life results. Moreover, for one of the preferred embodiments, the cutting teeth having an equilateral triangular profile which allows the cutting blades to be rotated three times to expose unused cutting edges before replacement is required.

These together with other advantages of the invention, along with the various features of novelty which characterize the invention are pointed out with particularity in the claims annexed to and forming a part of this disclosure. For a better understanding of the invention, its operating advantages and the specific objects attained by its use, reference should be had to the accompanying drawing and descriptive matter in which there is illustrated preferred embodiments of the invention.

SUMMARY OF THE INVENTION

The invention relates to a device for comminuting small chunks of recyclable work material, such as garbage, tires having steel belts and other material cords, refuse and loose particulate matter. The work material is comminuted through the use of a generally cylindrically walled rotary grinding drum which has cutting teeth engaged by an elongated holder disposed longitudinally along the peripheral surface of the rotary grinding drum and from which a portion of the cutting teeth are exposed outwardly, extending radially beyond the peripheral surface of the grinding drum.

It is the rotary movement of the drum with these extended teeth portions by which the work material is shred, torn, cut and grounded inside the stator to form powdered and crumb rubber, and other recyclable materials, thereby reducing incoming work material having outer dimensions of approximately three to four inches to a small mesh size crumb rubber, which may then be discharge from the device.

The invention resides not in any one of these features per se, but rather in the particular combination of all of them herein disclosed and claimed and it is distinguished from the prior art in this particular combination of all of its structures for the function specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein:

FIG. 12 is a block diagram of an arrangement of the present invention, together with associated control devices, which are preferred embodiment of the present invention;

FIG. 13 is a perspective view of a preferred embodiment of a cutting tooth of the present invention;

FIG. 14. is the top plan view of the preferred embodiment of a cutting tooth shown in FIG. 13 of the present invention;

FIG. 15 is a perspective view of a second preferred embodiment of a cutting tooth for the present invention;

FIG. 16 is the top plan view of the second preferred embodiment of the cutting tooth shown in FIG. 15 for the present invention;

FIG. 17 is a perspective view of a third preferred embodiment of a cutting tooth for the present invention; and FIG. 18 is the top plan view of the third preferred embodiment of the cutting tooth shown in FIG. 17 for the present invention.

DETAILED DESCRIPTION OF THE INVENTION

Figures 1, 2:
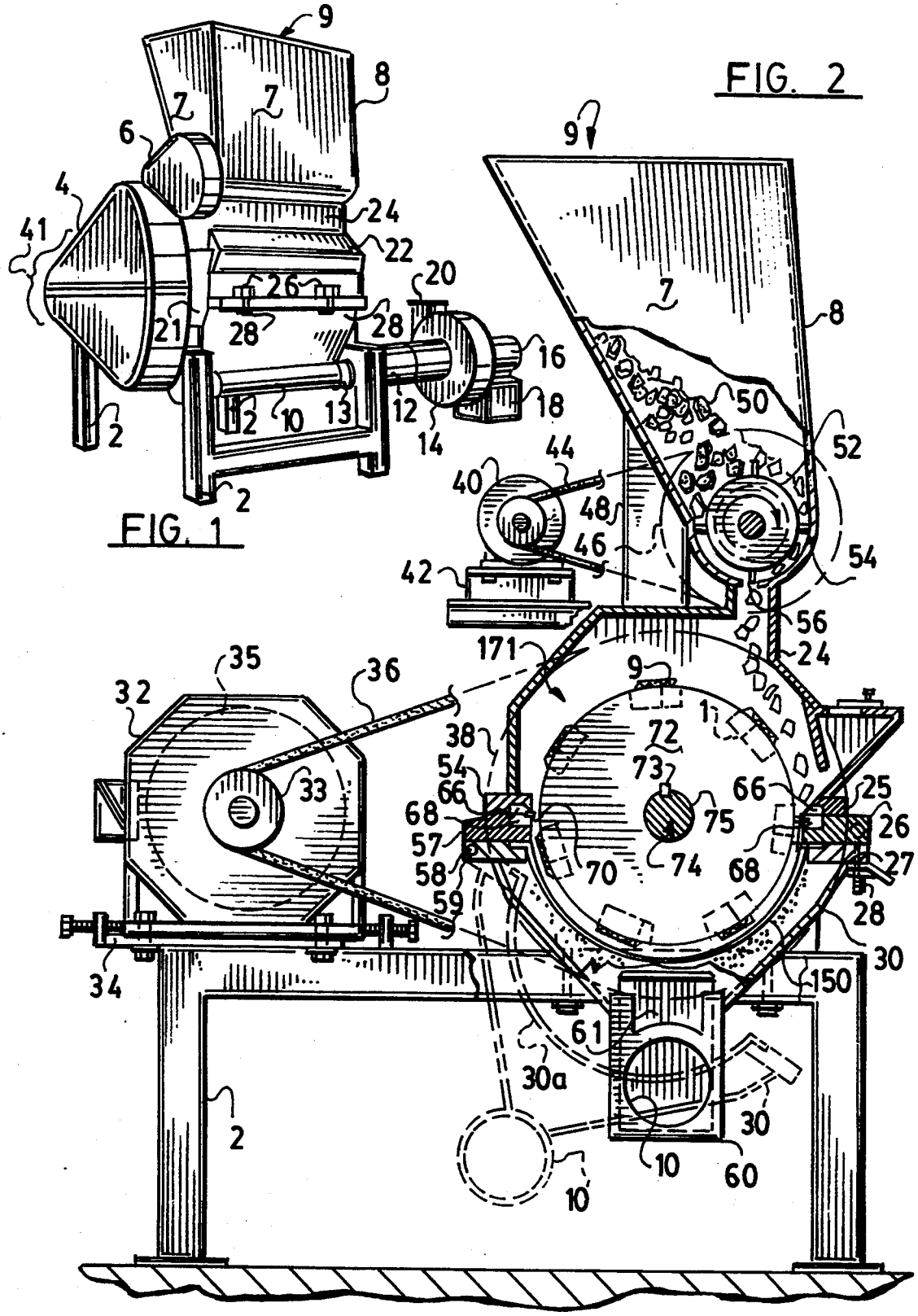
FIG. 1 is a perspective view of a first preferred embodiment of the present invention showing a hopper position above a stator casing which is resting on a support base, further showing the discharge piping connected to the exhaust blower.
FIG. 2 is a side elevation view of the first preferred embodiment of the present invention, partially cut away to show the path of the work material in the hopper and stator, the position of the feeder in the hopper, the position of the cylindrically walled rotary grinding drum and the stator cutting assemblies within the stator and in phantom the screen door is shown in an open position.

The preferred embodiment depicted in the drawing show a comminuting device comprising a generally cylindrically walled rotary grinding drum 72, said cylindrically walled rotary grinding drum having at least one drum cutting assembly 1 disposed generally longitudinally along the peripheral surface thereof.

Figure 3:
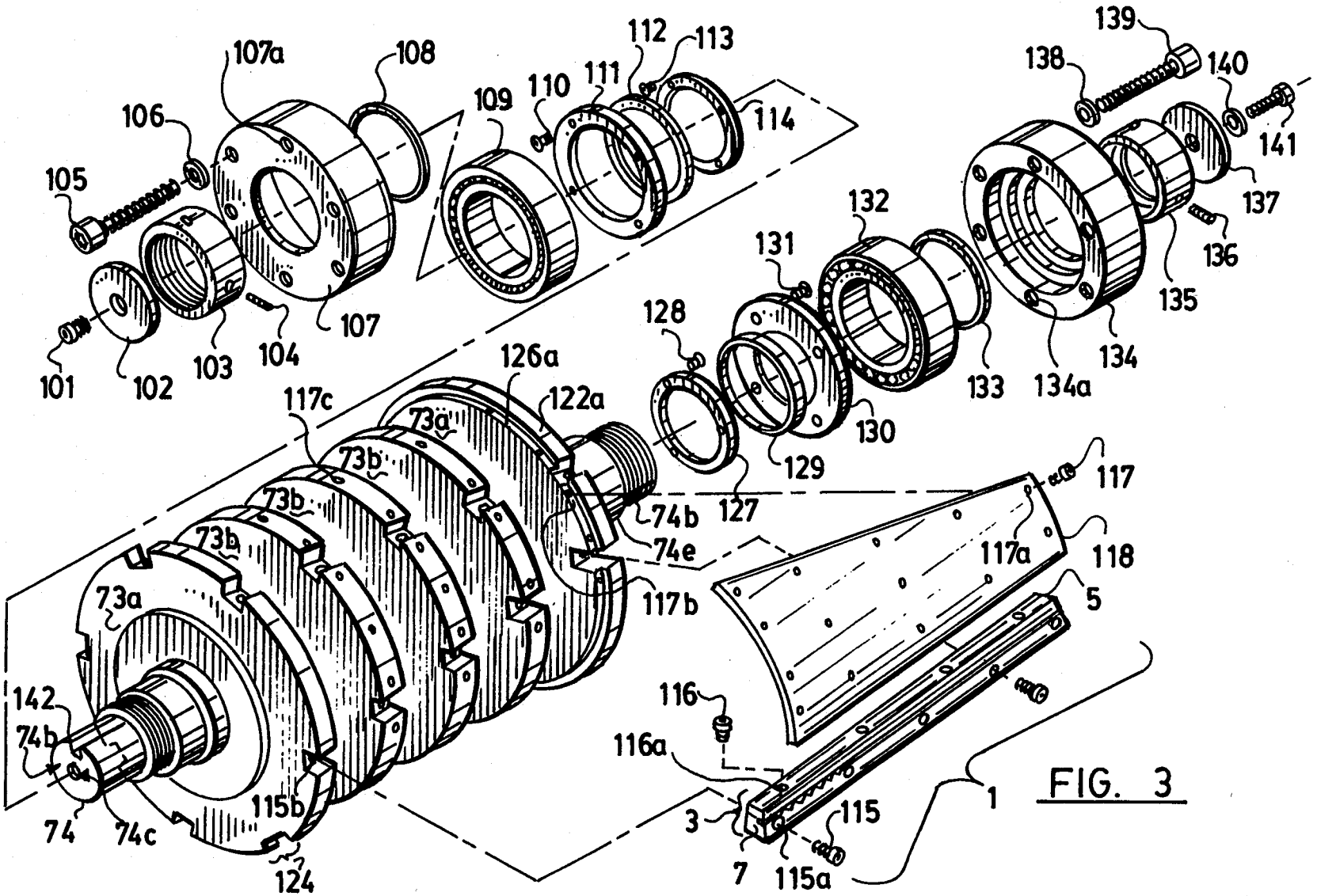
FIG. 3 is an exploded perspective view of the cylindrically walled rotary grinding drum of the present invention with its shaft components, elongated cutting assembly and cover plates disengaged.

Referring to FIG. 3, each said drum cutting assembly 1 has a drum elongated holder means 3 and a plurality of drum cutting teeth 9 engaged longitudinally to said drum elongated holder means 3. Each drum elongated holder means 3 disposed along the peripheral surface of the cylindrically walled rotary grinding drum 72 is arranged and adapted to have its outwardly disposed face form a portion of the peripheral surface of the cylindrically walled rotary grinding drum 72. Each of the drum cutting teeth 9 engaged to the drum elongated holder means 3 disposed along the peripheral surface of the cylindrically walled rotary grinding drum 72 is arranged and adapted to expose a drum cutting tip portion 9*a* (see FIG. 8) thereof from the outwardly disposed face of said drum elongated holder means 3, where each of said drum cutting tip portions 9*a* extending radially beyond the peripheral surface of the cylindrical grinding drum. Drive means for rotating the cylindrically walled rotary grinding drum 72 are provided.

Figure 4:
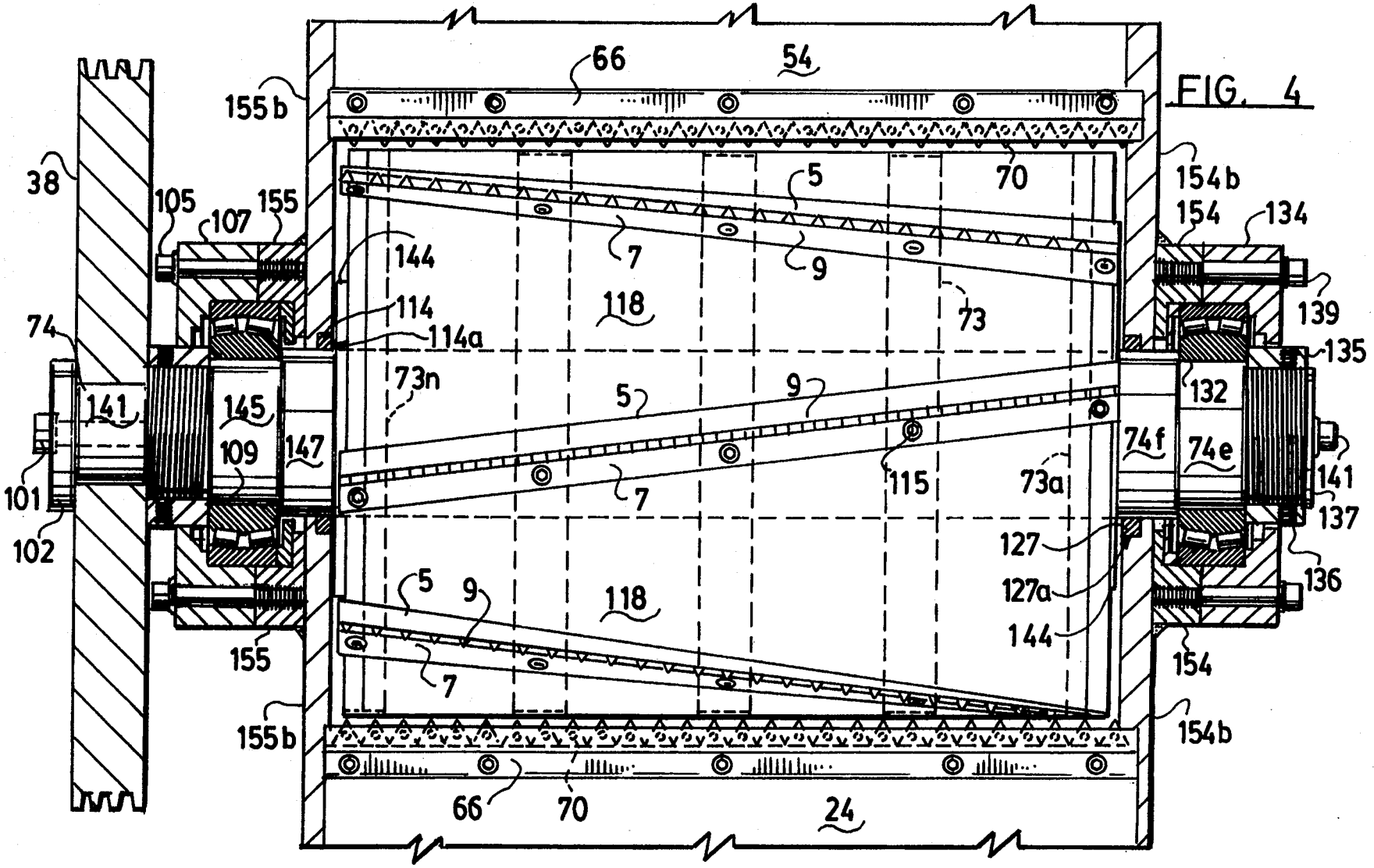
FIG. 4 is a horizontal sectional top plan view of a preferred embodiment of the present invention taken of the lower section of the split stator casing with the cylindrically walled rotary grinding drum disposed therein.

In a preferred embodiment of the invention, as shown in FIG. 4, at least one of the drum elongated holder means 3 disposed along the peripheral surface of the cylindrically walled rotary grinding drum 72 is helically shaped.

Referring to FIGS. 1 and 2, a general arrangement of a preferred embodiment of said device is shown. Of note is the positioning of a screen access door 30 and a discharge duct 10 connected thereto; and positioned on top is a material feed hopper 8 tandemly disposed above and mounted on the means for housing the cylindrically walled rotary grinding drum, having a work material feeder 52 disposed therein, with an outwardly disposed drive mechanism having a cover 6. The hopper 8 has an elongated outlet 56 which is positioned parallel to the axis of the cylindrically walled grinding drum 52 contained in the stator having an upper casing 24 and lower casing 21, and further comprising a screen access door 30 secured by a housing bolt assembly 26 having accessible housing bolts 28. The comminuting device is supported by a rigid base 2 securing the housing at sufficient elevations as the discharge duct 10 can be positioned underneath the lower stator housing casing 21 and connected to discharge piping 12 which feeds a blower 14 having a blower motor 16 and supporting base 18. A preferred embodiment has a rigid base 2 arranged and adapted to support said comminuting device at sufficient elevation above floor grade to permit the screen door 30, with the discharge duct 10 mounted thereto, to be moved from a raised position to a lowered position 30'.

The discharge duct 10 has at one end thereof an adjustable air inlet gate 60 to regulate the flow of process air, and a means to disconnect 13 said discharge duct from the blower.

As shown in FIG. 2, the work material 50 of varying sizes generally not having an outer dimension exceeding 4 inches, is positioned in the hopper 8 and flow thereof is regulated by a rotary feeder 52 having a substantially cylindrical drum with a plurality of paddles 54 disposed along the surface thereof and having an axis parallel to and positioned above said bottom opening 56 of said material feed hopper 8 parallel to the axis of the cylindrically walled grinding drum 72. In FIG. 1, the material feed hopper 8 has an elongated opening 9 at the top for receiving material to be comminuted, upright end walls 7 downwardly tapering, and a bottom opening 56 that is directly overlying, parallel to and in communication with the elongated opening 19 positioned in the means for housing the cylindrically walled rotary grinding drum 72.

The cylindrical drum of the rotary feeder 52, the bottom opening 56 of the material feed hopper 8, and the elongated opening 19 positioned in the means for housing the cylindrically walled rotary grinding drum 72, each having a length approximating the length of that portion of the cylindrically walled rotary grinding drum 72 having a drum cutting assembly 1 disposed thereon, such that the work materials may be fed along the entire length thereof to equalize the load on the drum cutting teeth 9.

The elongated rotary feeder 52 is disposed in a bottom portion of the material feed hopper 8 and it has an externally disposed variable speed motor, the feeder motor 40, connected to it on its own support base 42 and interconnected by belt drive means 44 connected to an external drive wheel 46, as shown in FIG. 2.

A variable speed motor, the grinder motor 35, generally rated from 40 to 100 horsepower for a one ton per hour capacity device, and having a shaft mounted motor drive wheel 33 provides the drive means for rotating the cylindrically walled rotary grinding drum 72 further comprising a suitably sized drive wheel 38, having a centrally located axial bore 75 suitably sized to fit the drive end of the shaft 74 with an offset keyway 142 extending axially along a surface of said bore 75, positioned on the drive end of the shaft 74, and a suitably sized and adapted key 73 positioned therein keying said drive wheel thereto. The respective drive wheels, 38 and 33, are suitably sized and adapted so that the cylindrically walled rotary grinding drum 72 can rotate between 50 and 350 rpm, depending on the work material size and capacity. High efficiency is obtained operating at 120 rpm.

The motor 35 rotating the grinding drum 72 is contained in a housing 32 and uses a belt drive 36 connected from the drive motor shaft wheel 33 to the drive wheel 38 for the cylindrically walled grinding drum 72. As shown in FIG. 2, the cylindrically walled grinding drum 72 generally rotates clockwise and has in its peripheral surface a plurality of drum cutting assemblies 1 comprising drum elongated holder means 3 having drum cutting teeth 9 extending beyond the peripheral surface of said drum 72.

A preferred embodiment of the comminuting device comprises a manual override to reverse the normal rotation of the cylindrically walled rotary grinding drum 72. Reference is made to FIG. 12, wherein a preferred embodiment of the comminuting device further comprises a control panel for activation by an by an individual operator. The controller when activated supplies power to the grinder, that is, the variable speed motor 35 that provides the drive means for rotating the cylindrically walled rotary grinding drum 72. Once the rotor reaches full speed, the circuit is energized and the feeder motor 40 is likewise activated.

If excessive material enters the region 171 around the cylindrically walled rotary grinding drum 72, both the feeder motor 40 and the grinder motor 35 may be shut down. In a preferred embodiment of the invention a load monitor for the motor 35 driving the cylindrically walled rotary grinding drum 72 is provided which adjusts the power supplied to the motor 40 for the rotary feeder 52 to coordinate work material throughput and reduce jamming.

Rotary airlock control, referenced in FIG. 12 of the drawing, substantially adjust the inlet air dampers 22 and the lower air inlet 60 having an air inlet gate 61 to accommodate the varying coarseness and comminuting rate of the work material. Regardless of whether the air inlets are automatically regulated, it would generally be required for fine work material that the inlet air dampers 22 be opened wider and that the an air inlet gate 61 of the lower air inlet 60 be positioned lower, and that for coarser work material that the inlet air dampers 22 be adjusted to be closed more and that the an air inlet gate 61 of the lower air inlet 60 have its position raised.

As shown in FIG. 2, the means for housing the cylindrically walled rotary grinding drum 72 comprising a stator in which the cylindrically walled rotary grinding drum can freely rotate. The stator comprising an inner wall section, shown here as the screen 150, has a generally cylindrical surface, arranged and adapted concentric with and in opposition to the cylindrically walled rotary grinding drum 72, with a radius of curvature sufficiently greater than the radius of said cylindrically walled rotary grinding drum, such that, upon rotation of the cylindrically walled rotary grinding drum 72, the drum cutting tip portions 9 and the inner wall section 150 may coact to comminute work material 50 passing therebetween. One of the objects of this invention is to comminute work materials to fines. Screen sizes ranging from 8–40 mesh are generally employed.

The stator further comprises a means for obstructing the flow of work material and process air 70, as shown in FIG. 2, said means are protruding from an inner wall section (54 and 57; and 25 and 26, respectively) towards said cylindrically walled rotary grinding drum 72. The means for obstructing the flow of work material and process air comprises a means for cutting. The means for cutting comprises at least one stator cutting assembly (66, 68 and 70) disposed generally along the peripheral surface of an inner wall section (54 and 57; and 25 and 26, respectively) of the stator.

The stator cutting assembly 100 has a stationary elongated holder means (66 and 68) and a plurality of stator cutting teeth 70 engaged longitudinally to said stationary elongated holder means.

Each stationary elongated holder means (66 and 68) disposed along the inner wall section is arranged and adapted to have a face (**66*a* and 68*a*, respectively) thereof form a portion of the peripheral surface of the inner wall section. (See FIG. 8**.)

Figures 7, 8, 9, 10, 11:
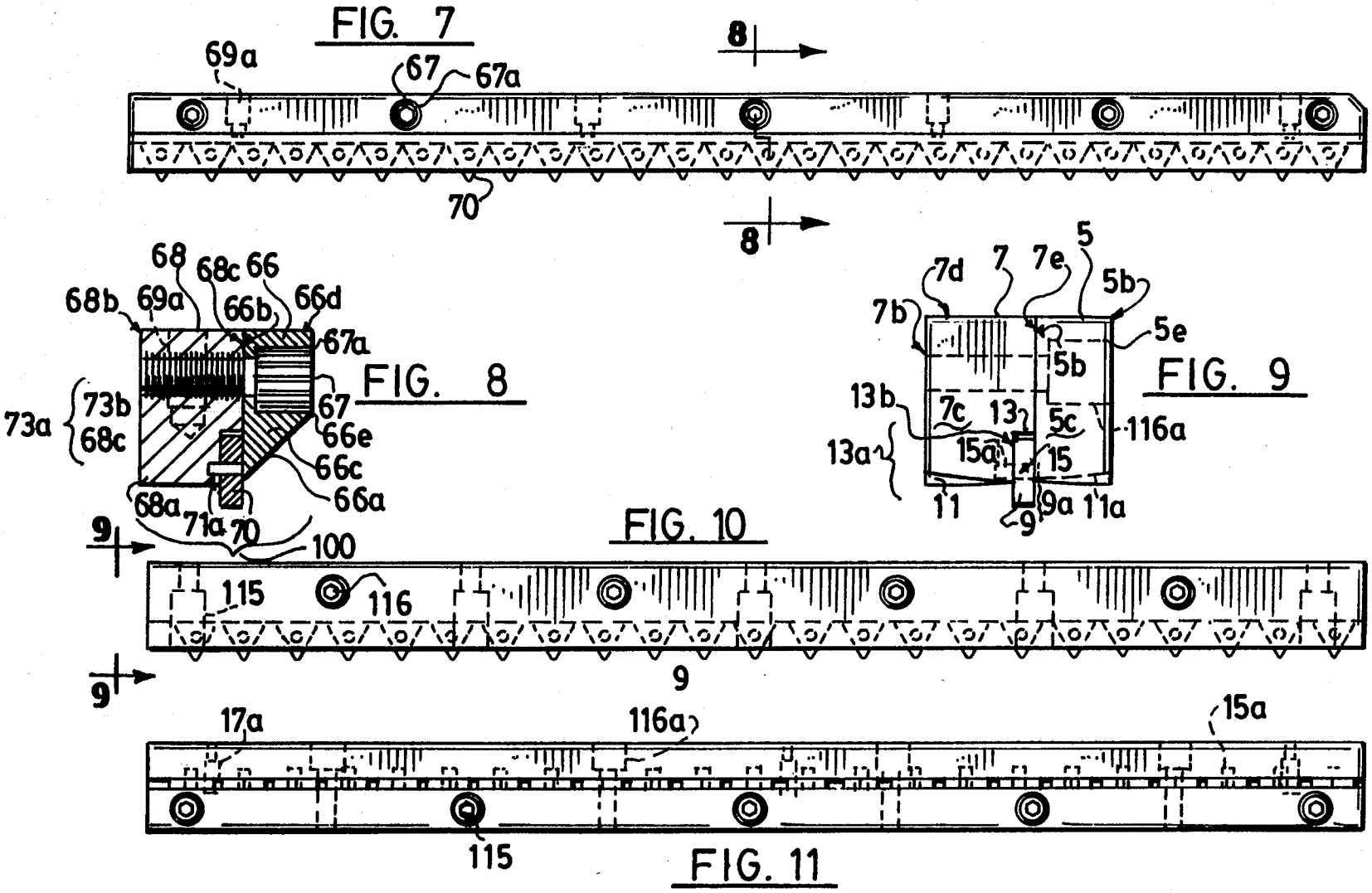
FIG. 7 is a top plan view of a preferred embodiment of the present invention of a stator cutting assembly.
FIG. 8 is an enlarged sectional view taken along the line 8—8 of FIG. 7, showing details of the upper and lower sections of the stator elongated holder means and a cutting tooth and a retaining pin.
FIG. 9 is an enlarged side elevation view taken generally along 9—9 of the drum cutting assembly of FIG. 10 showing the detail of the upper and lower sections of the drum elongated holder means and a cutting tooth and a retaining pin.
FIG. 10 is a top plan view of a preferred embodiment of the present invention of a drum cutting assembly.
FIG. 11 is a front elevation view of a preferred embodiment of the present invention of a drum cuting assembly showing the bore for the retaining pin positioned in the upper section of the drum elongated holder means.

Each of the stator cutting teeth 70, detailed in FIG. 8, engaged to the stationary elongated holder means (66 and 68) disposed along the inner wall section is arranged and adapted to expose a stator cutting tip portion **70*a* thereof from said face (66*a* and 68*a*) of the stationary elongated holder means (66 and 68) such that each said stator cutting tip portion 70*a* protrudes from the inner wall section towards said cylindrically walled rotary grinding drum 72 and interpolates, that is, the stator cutting tip portions 70*a* and the drum cutting tip portions 9*a* may progressively pass across each other in a generally evenly spaced relationship as the cylindrically walled rotary grinding drum 72** is rotated.

As shown in FIG. 2, a preferred embodiment of the present invention comprises each stationary elongated holder means disposed along the inner wall section being parallel to the axis of the cylindrically walled rotary grinding drum. Moreover, in the preferred embodiment of the invention shown in the drawing, the axis of the cylindrically walled rotary grinding drum 72 is generally horizontal.

Two stator cutting assemblies are shown as FIG. 2 having an upper section of a stationary elongated split holder casing 66 and a lower section thereof 68 engaging a stator cutter tooth 70. In a preferred embodiment of the invention, the two stator cutting assemblies (66 and 69), each arranged and adapted to position the recess bottom wall 73 of the lower section of the stationary elongated split holder casing 68 along a generally horizontal plane passing through axis of the cylindrically walled rotary grinding drum 72.

Referring again to FIG. 8, each stator cutting assembly 100 further comprises the stationary elongated holder means having a stationary elongated split holder casing with an upper and a lower section (66 and 68, respectively) mateable along a generally horizontal plane. Each of these sections has a generally a parallel congruent bottom wall (**66*b* and 68*b*, respectively) and a plurality of concentric vertical boreholes 67*a* suitably sized and adapted to accept a securing member, such as a threaded section mating bolt 67, with said upper section 66 having a bore 67*a* suitably sized to allow a head of bolt 67 to be recessed therein and with the lower section of said bore 67*a* having an internally threaded bore suitably sized and adapted to engage the threads of the bolt 67. Whereby, the respective upper and lower sections of the stationary elongated split holder casing (66 and 68) can be mated together to form the stationary elongated holder means. The upper section 66 thereof, in the preferred embodiment of the invention as shown in FIG. 8, further comprising a prism having a bottom wall 66*b*, two parallel congruent end walls 66*c*, each having a bottom edge, two side edges, a top edge and a side diagonal edge, a rear wall 66*d*, a top wall 66*e* and a top diagonal wall 66*a*, said top diagonal wall 66*a* having an upper rear edge, two side edges and a lower front edge, and said bottom wall 66*b* and said top wall 66*e* each generally lying in a horizontal plane, said rear and end walls (66*d* and 66*c*, respectively) each extending upwardly from and having their bottom edges connected to the rear and side edges, respectively, of the bottom wall 66*b*, said rear wall 66*d* having its side edges connected to the rear side edges, respectively, of the end walls 66*c*, said top wall 66*e* having its side edges connected to the top edges of the end walls 66*c*, respectively, its rear edge to the rear wall 66*d*, and its front edge to the upper rear edge of the top diagonal wall 66*a*, said top diagonal wall 66*a* further having its lower front edge connected to the front edge of the bottom wall 66*b* and its side edges, respectively, to the side diagonal edges of the end walls 66*c***.

The lower section 68 of the stationary elongated split holder casing comprising a square prism having an longitudinal recess **73*a* positioned along the upper front comer thereof suitably sized and adapted for positioning the stator cutting teeth 70 therein. The lower section 68** further comprises a bottom wall 68*b*, two parallel congruent end walls 68*c*, each having a bottom edge, a rear side edge, a front side edge, a top edge, a recess side edge and a recess bottom edge, a rear wall 68*d*, a front wall 68*a*, a top wall 68*e*, a recess bottom wall 73*b* and a recess rear wall 73. The bottom wall 68*b*, recess bottom wall 73*b* and top wall 68*e* each generally lying in a horizontal plane, said rear wall 73, front wall 68*a* and end walls 68*c* each extending upwardly from and having their bottom edges connected to the rear, front and side edges, respectively, of the bottom wall 68*b*, said rear wall 68*d* having its side edges connected to the rear side edges, respectively, of the end walls 68*c*, said top wall 68*e* having its side edges connected to the top edges of the end walls 68*c*, respectively, its rear edge to the upper edge of the rear wall 68*d*, and its front edge to the upper edge of the recess rear wall 73, said recess rear wall 73 having its lower edge connected to the rear edge of the recess bottom wall 73*b* and its side edges, respectively, to the recess side edges of the end walls 68*c*, said recess bottom wall 73*b* having its front edge connected to the upper edge of the front wall 68*a*, its side edges, respectively, to the recess side edges of the end walls 68*c*, and said front wall 68*a* having its side edges connected, respectively, to front side edges of the end walls 68*c*.

The lower section 68 thereof further comprises a plurality of horizontal boreholes 69*a* suitably sized and adapted to accept a stator securing member, such as the end of a threaded stator bolt, to secure the stationary elongated holder means to the inner wall section of the stator in conjunction with the plurality of horizontal boreholes 69*b* positioned therein. (See FIG. 6.)

The lower section 68 further comprises a plurality of vertical bores 71*a* in the recess bottom wall 73*b*, each suitably sized and adapted to accept a tooth retraining pin 71. The moth retraining pin 71 is arranged and adapted to position a stator cutting tooth 70 having a central bore (see FIGS. 13–18) suitably sized and adapted to accept said tooth retraining pin 71 to expose its stator cutting tip portion 70*a* from the outwardly disposed face of said stationary drum elongated holder means. An alternative embodiment is contemplated having the bores for the retaining pins positioned in the respective upper sections of the elongated holder means.

The plurality of stator cutting teeth 70, each comprise a prism having at least three side walls, and two parallel congruent top and bottom walls. When said bottom wall and said top wall are each oriented to lie in a horizontal plane, each of the side walls extends upwardly from and has its bottom edge connected to a side edge, respectively, of the bottom wall, each side wall having two side edges, each connected to a different side wall, said top wall having its side edges connected to the top edges of the side walls. (See FIGS. 13–18.)

Each stator cutting tooth 70 has an upwardly extending dimension of a side wall not exceeding the upwardly extending dimension of the recess rear wall 73 of the stationary elongated split holder casing.

Referring now to FIGS. 9 and 10, each of the drum cutting assembly 1 comprises drum elongated holder means having a drum elongated split holder casing with an upper and a lower section (5 and 7, respectively) mateable along a generally horizontal plane. Each such section has a generally a parallel congruent bottom wall (5*b* and 7*b*, respectively) and a plurality of transverse concentric boreholes 116*a* suitably sized and adapted to accept a securing member, such as a threaded section mating bolt 116, with said upper section 5 having a bore suitably sized to allow a bolt head to be recessed therein and with said lower section 7 having an internally threaded bore suitably sized and adapted to engage the threads thereof. Whereby, the respective upper and lower sections (5 and 7, respectively) of the drum elongated split holder casing can be mated together to form the drum elongated holder means.

The upper section 5 thereof has a bottom wall 5*b* and a top wall 5*e* parallel thereto, two parallel end walls 5*c*, a rear wall 5*d*, and a front wall 11*a*. The bottom wall 5*b* and said top wall 5*e* each generally lying in a generally horizontal plane, said rear wall 5*d* extending transversely upward and said end walls 5*c* each extending upwardly from and having their bottom edges connected to the rear and side edges, respectively, of the bottom wall 5*b*, said rear wall 5*d* having its side edges connected to the rear side edges, respectively, of the end walls 5*c*, said top wall 5*e* having its side edges connected to the top edges of the end walls 5*c*, respectively, its rear edge to the rear wall 5*d*, and its front edge to the front wall 11*a*, said front wall 11*a* further having its lower edge connected to the front edge of the bottom wall 5*b* and its side edges, respectively, to the side edges of the end walls 5*c*.

The lower section 7 thereof has a longitudinal recess 13*a* positioned along the upper front corner thereof suitably sized and adapted for positioning the drum cutting teeth 9 therein, and further comprising a bottom wall 7*b*, two parallel end walls 7*c*, each having a bottom edge, a rear side edge, a front side edge, a top edge, a recess side edge and a recess bottom edge, a rear wall 7*d*, a front wall 11, a top wall 7*e*, a recess bottom wall 13*b* and a recess rear wall 13. The bottom wall 7*b*, recess bottom wall 13*b* and top wall 7*e* each lie generally horizontal plane, said rear, front and end walls (7*d*, 11 and 7*c*, respectively) each extending upwardly from and having their bottom edges connected to the rear, front and side edges, respectively, of the bottom wall 7*b*, said rear wall 7*d* having its side edges connected to the rear side edges, respectively, of the end walls 7*c*, said top wall 7*e* having its side edges connected to the top edges of the end walls 7*c*, respectively, its rear edge to the upper edge of the rear wall 7*d*, and its front edge to the upper edge of the recess rear wall 13. The recess rear wall 13 has its lower edge connected to the rear edge of the recess bottom wall 13*b* and its side edges, respectively, to the recess side edges of the end walls 7*c*. The recess bottom wall 13*b* has its front edge connected to the upper edge of the front wall 11, its side edges, respectively, to the recess side edges of the end walls 7*c*, and the front wall 11 has its side edges connected, respectively, to front side edges of the end walls 7*c*.

The lower section 7 thereof further comprising a plurality of boreholes 115*a* transverse to the front wall 11 thereof, suitably sized and adapted to accept a drum securing member, such as a threaded drum bolt 115, each such borehole 115*a* having a bore suitably sized to allow a bolt head to be recessed therein as the threaded section of said bolt protrudes from the back wall thereof and engages the recess 124 having a radially internally threaded bore 115*b* to secure a threaded bolt 115 on the annular surface of a supporting disks (73*a*–73*n*, respectively) of the cylindrically walled rotary grinding drum 72.

Said lower section 7 thereof further comprising a plurality of bores 15*a* in the recess bottom wall 13*b*, each suitably sized and adapted to accept a tooth retraining pin 71, and further arranged and adapted to position a drum cutting tooth 9 having a central bore 15 suitably sized and adapted to accept said tooth retraining pin 71 to expose its drum cutting tip portion 9*a* from the outwardly disposed face of said drum elongated holder means (5 and 7), and having a plurality of threaded section mating bolts 116, a plurality of tooth restraining pins 71, and a plurality of threaded drum bolts 115, to secure the drum cutting assembly 1 to the drum 72.

The drum elongated holder means 3 and the stator elongated holder means are best made of materials resistance to distortion and wear. Prehardened 43/40 steel having a Rockwell Hardness in the range of 38–42 is preferred.

In such preferred embodiment, the plurality of drum cutting teeth 9, each having a central bore 15 suitably sized and adapted to accept a tooth retraining pin 71 and further comprising a prism having at least three side walls 9*b*, and two parallel congruent top and bottom walls (9*e* and 9*b*, respectively). As said bottom wall 9*b* and said top wall 9*e* are each oriented to lie in a horizontal plane, each said side wall 9*c* extending upwardly from and having its bottom edge connected to a side edge, respectively, of the bottom wall 9*b*; and each side wall 9*c* having two side edges, each connected to a different side wall 9*c*, and said top wall 9*e* having its side edges connected to the top edges of the side walls 9*c*.

In another preferred embodiment, at least one of the drum cutting assembly comprises an upper section 5 thereof having a bottom wall 5*b* and a top wall 5*e* parallel thereto, two parallel end walls 5*c*, a rear wall 5*d*, and a helical ribbon shaped front wall 11. The bottom wall 5b and said top wall 5*e* each generally lying in a plane oblique to axis 72*a* of the cylindrically walled rotary grinding drum 72, said rear wall 5*d* extending transversely upward and said end walls 5*c* each extending upwardly from and having their bottom edges connected to the rear and side edges, respectively, of the bottom wall 5*b*, said rear wall 5*d* having its side edges connected to the rear side edges, respectively, of the end walls 5*c*, said top wall 5*e* having its side edges connected to the top edges of the end walls 5*c*, respectively, its rear edge to the rear wall 5*d*, and its front edge to the front wall 11*a*, said front wall 11*a* further having its lower edge connected to the front edge of the bottom wall 5*b* and its side edges, respectively, to the side edges of the end walls 5*c*.

The lower section 7 thereof having a longitudinal recess 13*a* positioned along the upper front corner thereof suitably sized and adapted for positioning the drum cutting teeth 9 therein, and further comprising a bottom wall 7*b*, two parallel end walls 7*c*, each having a bottom edge, a rear side edge, a front side edge, a top edge, a recess side edge and a recess bottom edge, a rear wall 7*d*, a helical ribbon shaped front wall 11, a top wall 7*e*, a recess bottom wall 13*b* and a recess rear wall 13. The bottom wall 7*b*, recess bottom wall 13*b* and top wall 7*e* each generally lying in a plane oblique to axis 72*a* of the cylindrically walled rotary grinding drum 72, said rear, front and end walls (7*d*, 11 and 7*c*, respectively) each extending upwardly from and having their bottom edges connected to the rear, front and side edges, respectively, of the bottom wall 7*b*, said rear wall 7*d* having its side edges connected to the rear side edges, respectively, of the end walls 7*c*, said top wall 7*e* having its side edges connected to the top edges of the end walls 7*c*, respectively, its rear edge to the upper edge of the rear wall 7*d*, and its front edge to the upper edge of the recess rear wall 12. The recess rear wall 13 having its lower edge connected to the rear edge of the recess bottom wall 13*b* and its side edges, respectively, to the recess side edges of the end walls 7*c*. The recess bottom wall 13*b* having its front edge connected to the upper edge of the front wall 11, its side edges, respectively, to the recess side edges of the end walls 7*c*, and said front wall 11 having its side edges connected, respectively, to front side edges of the end walls 7*c*.

Each drum cuffing tooth 9 having an upwardly extending dimension of a side wall 9*c* not exceeding the upwardly extending dimension of the recess rear wall 13 of the drum elongated split holder casing 3.

In a preferred embodiment of the invention, each of the cutting teeth (9 and 70, respectively) of the drum cutting assembly 1 and each stator cutting assembly 100 are identically shaped.

Each drum cutting tip portion 9*a* and each stator cutting tip portion 70*a* has a tip angle $\alpha$, which angle does not exceed 90°, defined by the angle between the side walls of said cutting tip portion exposed from the outwardly disposed face of the drum and stator elongated holder means, respectively.

Each such cutting tooth (9 and 70, respectively) has a distance between the center of its central bore and its cutting tip equal to $\Phi$. Each drum cutting tooth 9 and each stator cutting tooth 70 has an upwardly extending dimension of its side wall equal to $\infty$, which is sufficiently less than the upwardly extending dimension of the recess rear wall (13 and 73), respectively, of the drum elongated split holder casing (5 and 7) and the stator elongated split holder casing (66 and 68), to allow rotating movement of each tooth (9 and 70, respectively) about its tooth restraining pin (71) upon impact with work material passing therebetween.

In a preferred embodiment, the recess rear wall (13 and 73) of the respective elongated split holder casings is arranged and adapted to restrict the rotating movement of each tooth about its tooth restraining pin (71 and 15*a*, respectively). An angle not exceeding $(45°-\frac{1}{2}\alpha)$ in either direction from a plane passing through such restraining pin 71 and transverse to its elongated split holder casing (66 and 68, and 5 and 7, respectively) is preferred. Since the stator cutting tip portions 70*a* are arranged in interpolative relation with the drum cutting tip portions 9*a* as the cylindrically walled rotary grinding drum 72 rotates about its axis a minimum clearance $\Theta$ between the respective cutting tip positions must be maintained. The distance $\Sigma$ between the central bores of adjacent teeth on the stator can be calculated and is approximated by a trigonometric equation $$\Sigma = 4101 \sin(45°-\tfrac{1}{2}\alpha) + \infty \tan\beta + 2\Theta + \delta,$$

where $\beta$ is the angle between a plane passing through the teeth 9 of the drum cutting assembly 1 and the horizontal plane, $\delta$ is the incremental axial expansion between adjacent cutting teeth 9 on the cylindrically walled rotary grinding drum 72.

In such preferred embodiment where the top and bottom walls of each cutting tooth (9 and 70, respectively), each essentially comprise an equilateral triangle, the recess rear wall 13 of the longitudinal recess 13*a* of the lower section 7 of the drum elongated holder means (5 and 7) has a generally congruent surface to the helical ribbon shaped front wall 11 thereof, the recess rear wall 73 of the longitudinal recess 73*a* of the lower section 68 of the stator elongated holder means (66 and 68) has a generally flat surface parallel the front wall 71 thereof, the transverse distance r between the central bore 15 of each cutting tooth (1 and 100) and the recess rear wall (13 and 73, respectively) of the longitudinal recess (13*a* and 73*a*, respectively) can be calculated and is approximated by a trigonometric equation $$\Gamma = \Phi \div (\sqrt{2})$$

Additionally, in a preferred embodiment of the invention, as shown in FIG. 4, the position of the stator cutting teeth 70 in one stationary elongated holder means 66 are transversely offset in relation to the position of the stator cutting teeth 70 in the other. In such preferred embodiment, each of the drum cutting teeth 9 in each drum cutting assembly 1 has an angle $\beta$, between the plane passing through the teeth 9 of said drum cutting assembly 1 and the horizontal plane, exposing a drum cutting tip portion 9*a* having a top and a bottom wall (9*e* and 9*b*, respectively) at an oblique angle $\beta$ to the horizontal plane, each of said cutting tip portions 9*a* further comprises a portion of two side walls 9*c*. A leading edge is comprised of an intersection of each side wall 9*c* of said cutting tip portion 9*a* with an edge of the top wall 9*e* or the bottom wall 9*b*. An interpolative cutting edge comprises the leading edge on a drum cutting tip portion 9*a* first entering the plane of the stator cutting teeth 70 in one stationary elongated holder means relative to the other leading edges on said cutting tip portion 9*a*. Each such interpolative cutting edge of a drum cutting tip portion 9*a* is arranged and adapted to interpolatively engage a stator cutting tooth 70 in each of the stationary elongated holder means (66 and 68). Such cutting teeth are fashioned from commercially available materials designed for heavy impact applications for metal forming operations, such as cemented carbide having an industrial designation ISO/G-35, grade WA-96, generally comprised of WC(84) and CO(16); and having a RA Hardness in the range of 85.0–90.0, density: 13.9 gms/cc, T.R.S.: 410,000 psi, and 7–10 percent abrasion resistance. Standard techniques for surface hardening will further prolong tooth life.

Figures 5, 6:
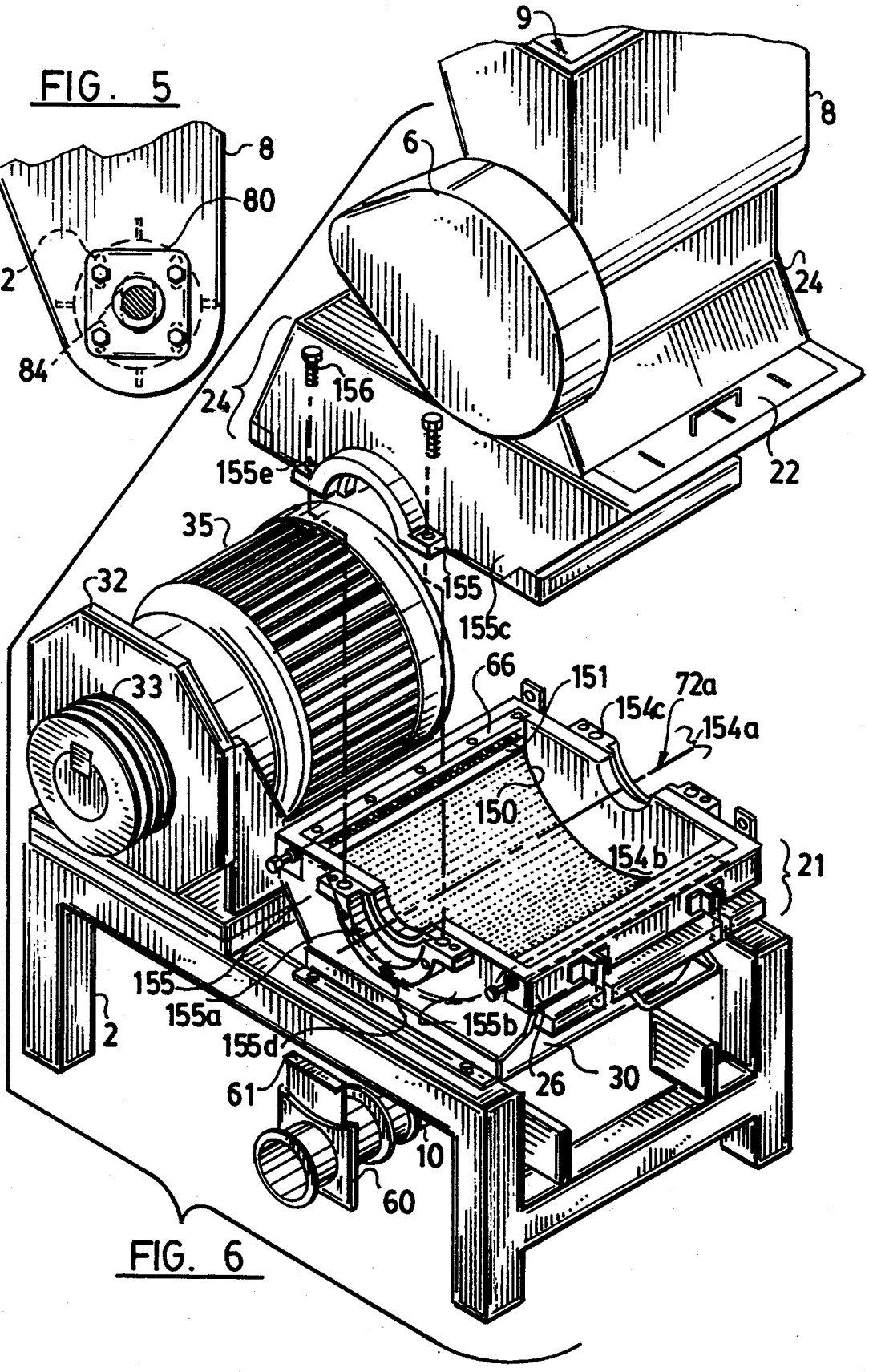
FIG. 5 is a partial side elevation view of a preferred embodiment of the present invention showing the detail of the manual adjustment for the hopper feeder.
FIG. 6 is an exploded perspective view of a preferred embodiment of the present invention with the cylindrically walled rotary grinding drum removed and with the upper and lower sections of the split stator casing exploded for greater detail.

FIG. 3 shows an exploded view of the cylindrically walled grinding drum 72 comprising a shaft 74 rotatably and axially journaled in said stator 41, said shaft 74 having a drive end 74*b* and a free end 74*a*. In proportion, a preferred embodiment, a shaft having an overall length of 42.94 inches has an undiminished diameter of 5.69 inches. As shown in FIG. 6, each such end extending through an aperture (154*a* and 155*a*, respectively) in the stator drive end wall (155*b* and 155*c*) and stator free end wall (154*b* and 154*c* (not shown)), respectively.

Reference is made to FIGS. 3 and 4 in which each such end further having a central axially internally threaded bore 74*c* arranged and adapted to accept a securing member, such as a screw 101, and each such end having a series of step portions of radially increasing diameter commencing at each of its terminal ends. On the free end 74*a* of the shaft 74 has a series of step portions of radially increasing diameter commencing with an externally threaded step portion 74*d* proximate to the end thereof sized and adapted to accept a threaded bearing locking member 135, proximate thereto the shaft having a journal bearing step portion 74*e* suitably sized and adapted to accept a beating 132, and the free end of the shaft has a further step portion 74*f* proximate thereto suitably sized radially to provide an axial inner shoulder for the bearing 132 and of suitable length axially to permit sufficient clearance between the bearing and an external surface of the stator free end wall (154*b* and 154*c*) through which said free end of the shaft extends.

The drive end 74*b* of the shaft 74 having a series of step portions of radially increasing diameter commencing with a first step portion 14 1 proximate to the end thereof sized and adapted to affix a drive wheel 38 thereto and having an offset keyway 142 extending axially along the peripheral surface of said first step portion 141 to secure said drive wheel 38 to the shaft 74, an externally threaded step portion 143 proximate thereto sized and adapted to accept a threaded bearing locking member 103, proximate thereto the shaft 74 having a journal bearing step portion 145 suitably sized and adapted to accept a bearing 109, and said drive end 74*b* of shaft 74 has a further step portion 147 proximate thereto suitably sized radially to provide an axial inner shoulder for said bearing 109 and of suitable length axially to permit sufficient clearance between the bearing 109 and an external surface of the stator drive end wall (155*b* and 155*c*) through which said drive end of the shaft extends.

As shown in FIG. 3, at least one peripheral cover plate 118 of generally uniform thickness suitably sized and adapted to form a portion of the peripheral surface of the cylindrically walled rotary grinding drum 72 not provided by each drum elongated holder means 3 disposed along the peripheral surface thereof, each such peripheral cover plate 118 has a plurality of boreholes 117*a* arranged and adapted to receive a securing member, such as a flat head screw 117, to secure said peripheral cover plate 118 to the cylindrically walled rotary grinding drum 72.

The cylindrically walled rotary grinding drum 72 further comprises a plurality of supporting disks (73*a*–73*n*) rigidly disposed at axially spaced intervals along the shaft 74 between the respective step portions (74*f* and 147, respectively) that provide an axial inner shoulder for a bearing, each such supporting disk lying in a plane transverse to the axis 72*a* of the shaft 72 and being coaxially positioned therewith. Each of the supporting disks (73*a*–73*n*) has a generally annular peripheral surface and at least one recess 124 on said annular surface having a radially internally threaded bore 115*b* to secure a threaded bolt 115 adapted to engage a longitudinal section of the drum elongated holder means 3 of the drum cutting assembly 1.

The supporting disk 73*a* proximate to the free end 74*a* of the shaft 74 and the supporting disk 73*n* proximate to the drive end 74*b* of the shaft, comprise the end supporting disks (73*a* and 73*n*), each such end supporting disk has a series of step portions of radially varying diameter, each such end supporting disk has an endwardly directed surface 144*a* connected to an annular step portion 144 having a diameter less than the diameter of the cylindrically walled rotary grinding drum 72 and an axial length sufficient to allow process air to pass between said end supporting disk (73*a* and 73*n*) and the respective stator end wall(154*b* and 155*b*, respectively). A proximate step portion having a peripheral surface (122*a* and 122*n*, respectively) of each such end supporting disk (73*a* and 73*n*) has a diameter essentially that of the cylindrically walled rotary grinding drum 72, and moving away from the respective shaft ends, a further proximate step portion (126*a* and 126*n*, respectively) is provided, having a diameter essentially that of the cylindrically walled rotary grinding drum 72 reduced by the thickness of the peripheral cover plate 118 and having a plurality of boreholes 117*b* radially arranged in the peripheral surface of said step portion (126*a* and 126*n*) to receive a securing member, such as a flat head screw 117, to secure said peripheral cover plate to the outer supporting disks (73*a* and 73*n*).

Each supporting disk 73*b* between the end supporting disks (73*a* and 73*n*) has a diameter essentially that of the cylindrically walled rotary grinding drum 72 reduced by the thickness of the peripheral cover plate 118 and each such disk has a plurality of boreholes 117*c* radially arranged in its generally annular peripheral surface 120 to receive a securing member, such as a flat head screw 117, to secure said peripheral cover plate to the outer supporting disks 73*b*.

FIGS. 6 and 7 show a preferred embodiment of the present invention with the cylindrically walled rotary grinding drum 72 removed and with the upper and lower sections of the split stator casing (24 and 21, respectively).

FIGS. 7 is a top plan view of a preferred embodiment of the present invention of a stator cutting assembly 100.

Referring to FIG. 6, the means for housing the cylindrically walled rotary grinding drum comprises a stator drive end wall 155*b* and a stator free end wall 154*b*, comprising the stator end walls, each having an aperture (155*a* and 154*a*, respectively) and an annular wall dirt ring recess (114*a* and 127*a*, respectively) therein arranged coaxially with the cylindrically walled rotary grinding drum 72. The stator having a split stator casing with an upper and a lower section (24 and 21, respectively) mateable along a generally horizontal plane passing through center of the aperture of each stator end walls, and means for attaching the upper section of the stator casing to the lower section thereof.

The means for mounting the cylindrically walled rotary grinding drum such that the cylindrically walled rotary grinding drum 72 can rotate in said stator 41 comprises an annular collar (154 and 155, respectively) secured externally to each of the respective stator end walls (154*b* and 155*b*, respectively) and arranged coaxially with the aperture (154*a* and 155*a*, respectively) therein, and said annular collar having a plurality of internally threated boreholes (154*d* and 155*d* (not shown), respectively). Each such annular collar having two substantially identical mating half collars with parallel flanges having at least one mating borehole (155*e* and 154*e* (not shown), respectively) arranged therein to receive a securing member such as a mating nut and bolt 156, each such half collar positioned on a respective upper and lower stator end wall section, and each such half collar arranged and adapted to be joined together as the upper and lower sections of the stator casing are mated together with the means for attaching the upper section of the stator casing to the lower section thereof.

The means for mounting the cylindrically walled rotary grinding drum such that the cylindrically walled rotary grinding drum can rotate in said stator further comprises, for each end of the shaft: at least one dirt ring (114 and 127, respectively) arranged and adapted to be mounted in the annular wall dirt ring recess (114*a* and 127*a*, respectively) of each one of the stator end walls (154*b* and 155*b*, respectively) as shown in FIG. 4.

Referring to FIG. 3, a seal ( 112 and 129, respectively), a bearing seal locking plate (111 and 130, respectively) axially abutting a beating (to accommodate operational expansion of the shaft, an additional bearing clearance may be provided on the free end bearing of 0.003"), a bearing (109 and 132, respectively), a bearing seal (108 and 133, respectively), a bearing cover (107 and 134, respectively) having a plurality of boreholes (107*a* and 134*a*, respectively), each arranged to receive one of a plurality of bearing cover securing bolt (105 and 139, respectively). A self-aligning double row roller beating having a raceway of outer ring spherical rollers guided by a cage and two integral fibs on the inner ring should be available commercially to meet the demanding needs of this invention. Size of the machine, its components, speed of operation, work material, and materials of construction will determine normal operating parameters. For an embodiment allowing a minimum clearance of 0.003" between interpolated teeth and as otherwise described herein, axial expansion of 2-3 hundredth of an inch can be anticipated.

Additionally, the threaded bearing locking member may have at least one transverse set screw (104 and 136, respectively). The means for mounting the cylindrically walled rotary grinding drum such that the cylindrically walled rotary grinding drum can rotate in said stator further comprises a shaft end cap (102 and 137, respectively) and a threaded screw (101 and 141, respectively) positioned in the central axially internally threaded bore 74*c* in the end of each end of the shaft 74. Whereby, in combination with said shaft, the threaded screw secures said shaft end cap which secures said the threaded lock washer which secures the bearing axially and the plurality of bearing cover securing bolts secure the bearing cover to the annular collar to secure the bearing radially which in combination secures the shaft radially and axially.

In a preferred embodiment of this invention, the cylindrically walled rotary grinding drum 72 comprises seven drum cutting assembly 1 disposed along the peripheral surface thereof. At least six of these have an angle $\beta$, between the plane passing through the teeth of said drum cutting assemblies and the horizontal plane.

In a preferred embodiment of this invention, only one interpolative cutting edge interpolatively engages a stator cutting tooth at any moment during rotation.

FIG. 6 shows an embodiment of the inner wall section of stator 41 further comprises at least one elongated foraminated screen 150 forming a semicircular ring sector generally positioned below and concentric with said cylindrically walled rotary grinding drum 72. Each of the elongated foraminated screens 150 have generally horizontally disposed flanges 151 extending from the longitudinal ends thereof. Each said horizontally disposed flange 151 is arranged and adapted to be secured to the means for housing the cylindrically walled rotary grinding drum casing, i.e., the stator 41. The means for housing the cylindrically walled rotary grinding drum further comprises a curved screen access door 30 generally with curved lateral ends positioned generally concentrically with and below the elongated foraminated screen 150 and having its lateral ends in engaging contact with the means for housing the cylindrically walled rotary grinding drum when said door is in a closed position.

The screen access door 30 is hingedly connected to and having a horizontal hinge 58 and a means to secure said screen access door 30, such as a pivotal bolt 28. As shown in FIG. 2, the screen access door operating between a raised position 30 during operation wherein said means to secure said screen access door is employed and said door is closed, and a lowered position 30' for access to the elongated foraminated screen. The screen door 30 further has a passageway 30a positioned below and in communication with the screen 150 through which comminuted work material may pass.

The means for allowing work material and process air into and out of a region between the cylindrically grinding drum and said stator further comprises: an elongated opening 22 positioned in the means for housing the cylindrically walled rotary grinding drum parallel to the axis of the cylindrically walled rotary grinding drum 72; and a discharge duct 10 mountingly disposed below and in communication with the passageway 30a of the screen door 150; an air control damper 22 in the means for housing the cylindrically walled rotary grinding drum having an elongated opening and an adjustable cover plate to regulate the inflow of process air. The process air may be controlled by automatic dampers connected to a controller in another embodiment of the invention.

FIG. 5 shows a partial side elevation view of a preferred embodiment of the present invention showing the detail of a means to manually adjustment the position of the hopper feeder so that it may be re-positioned for various sizes of work material.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What I claim is:

1. A comminuting device comprising:

a. a generally cylindrically walled rotary grinding drum, said cylindrically walled rotary grinding drum having at least one drum cutting assembly disposed generally longitudinally along the peripheral surface thereof, each said drum cutting assembly having a drum elongated holder means and a plurality of drum cutting teeth engaged longitudinally to said drum elongated holder means, each drum elongated holder means disposed along the peripheral surface of the cylindrically walled rotary grinding drum is arranged and adapted to have its outwardly disposed face form a portion of the peripheral surface of the cylindrically walled rotary grinding drum, each of the drum cutting teeth engaged to the drum elongated holder means disposed along the peripheral surface of the cylindrically walled rotary grinding drum is arranged and adapted to expose a drum cutting tip portion thereof from the outwardly disposed face of said drum elongated holder means, each of said drum cutting tip portions extending radially beyond the peripheral surface of the cylindrical grinding drum;

b. drive means for rotating the cylindrically walled rotary grinding drum;

c. means for housing the cylindrically walled rotary grinding drum comprising a stator in which the cylindrically walled rotary grinding drum can freely rotate, means for mounting the cylindrically walled rotary grinding drum such that the cylindrically walled rotary grinding drum can rotate in said stator, and means for allowing work material and process air into and out of a region between the cylindrically walled rotary grinding drum and said stator, said stator further comprising an inner wall section having a generally cylindrical surface, arranged and adapted concentric with and in opposition to the cylindrically walled rotary grinding drum, with a radius of curvature sufficiently greater than the radius of said cylindrically walled rotary grinding drum, such that, upon rotation of the cylindrically walled rotary grinding drum, the drum cutting tip portions and the inner wall section may coact to comminute work material passingtherebetween.

2. The comminuting device of claim 1, in which the stator further comprises a means for obstructing the flow of work material and process air, said means protruding from the inner wall section towards said cylindrically walled rotary grinding drum and arranged in interpolative relation with said drum cutting tip portions as the cylindrically walled rotary grinding drum is rotated.

3. The comminuting device of claim 2, in which the means for obstructing the flow of work material and process air comprises a means for cutting.

4. The comminuting device of claim 3, in which the means for cutting comprises at least one stator cutting assembly disposed generallyalong the peripheral surface of the inner wall section of the stator, said stator cutting assembly having a stationary elongated holder means and a plurality of stator cutting teeth engaged longitudinally to said stationary elongated holder means, each stationary elongated holder means disposed along the inner wall section is arranged and adapted to have a face thereof form a portion of the peripheral surface of the inner wall section, each of the stator cutting teeth engaged to the stationary elongated holder means disposed along the inner wall section is arranged and adapted to expose a stator cutting tip portion thereof from said face of the stationary elongated holder means such that each said stator cutting tip portion protrudes from the inner wall section towards said cylindrically walled rotary grinding drum and interpolates with said drum cutting tip portions as the cylindrically walled rotary grinding drum is rotated.

5. The comminuting device of claim 4, wherein each stationary elongated holder means disposed along the inner wall section is parallel to the axis of the cylindrically walled rotary grinding drum.

6. The comminuting device of claim 5, wherein the axis of the cylindrically walled rotary grinding drum is generally horizontal.

7. The comminuting device of claim 6, wherein at least one of the drum elongated holder means disposed along the peripheral surface of the cylindrically walled rotary grinding drum is helically shaped.

8. The comminuting device of claim 7, wherein a. the means for housing the cylindrically walled rotary grinding drum comprises:

(1) a stator drive end wall and a stator free end wall, comprising the stator end walls, each having an aperture and an annular wall dirt ring recess therein arranged coaxially with the cylindrically walled rotary grinding drum;

(2) the stator having a split stator casing with an upper and a lower section mateable along a generally horizontal plane passing through center of the aperture of each of the stator end walls, and means for attaching the upper section of the stator casing to the lower section thereof;

b. the cylindrically walled rotary grinding drum comprises:

(1) a shaft rotatably and axially journaled in said stator, said shaft having a drive end and a free end, each such end extending through an aperture in the stator drive end wall and stator free end wall, respectively, each such end further having a central axially internally threaded bore arranged and adapted to accept a securing member, such as a screw, and each such end having a series of step portions of radially increasing diameter commencing at each of its terminal ends, said free end of the shaft having a series of step portions of radially increasing diameter commencing with an externally threaded step portion proximate to the end thereof sized and adapted to accept a threaded bearing locking member, proximate thereto the shaft having a journal beating step portion suitably sized and adapted to accept a bearing, and said free end of the shaft having a further step portion proximate thereto suitably sized radially to provide an axial inner shoulder for said bearing and of suitable length axially to permit sufficient clearance between the bearing and an external surface of the stator free end wall through which said free end of the shaft extends, said drive end of the shaft having a series of step portions of radially increasing diameter commencing with a first step portion proximate to the end thereof sized and adapted to affix a drive wheel thereto and having an offset keyway extending axially along the peripheral surface of said first step portion to secure said drive wheel to the shaft, an externally threaded step portion proximate thereto sized and adapted to accept a threaded bearing locking member, proximate thereto the shaft having a journal bearing step portion suitably sized and adapted to accept a bearing, and said drive end of the shaft having a further step portion proximate thereto suitably sized radially to provide an axial inner shoulder for said bearing and of suitable length axially to permit sufficient clearance between the bearing and an external surface of the stator drive end wall through which said drive end of the shaft extends, (2) at least one peripheral cover plate of generally uniform thickness suitably sized and adapted to form a portion of the peripheral surface of the cylindrically walled rotary grinding drum not provided by each drum elongated holder means disposed along the peripheral surface thereof, each such peripheral cover plate having a plurality of boreholes arranged and adapted to receive a securing member, such as a flat head screw, to secure said peripheral cover plate to the cylindrically walled rotary grinding drum, (3) a plurality of supporting disks rigidly disposed at axially spaced intervals along the shaft between the respective step portions that provide an axial inner shoulder for a bearing, each such supporting disk lying in a plane transverse to the axis of the shaft and being coaxially positioned therewith, each of the supporting disks having a generally annular peripheral surface and at least one recess on said annular surface having a radially internally threaded bore to secure a threaded bolt adapted to engage a longitudinal section of the drum elongated holder means of the drum cutting assembly, the supporting disk proximate to the free end of the shaft and the supporting disk proximate to the drive end of the shaft, comprising the end supporting disks, each such end supporting disk has a series of step portions of radially varying diameter, each such end supporting disk has an endwardly directed surface connected to a annular step portion having a diameter less than the diameter of the cylindrically walled rotary grinding drum and an axial length sufficient to allow process air to pass between said end supporting disks and the respective stator end wall, a proximate step portion of each such end supporting disk having a diameter essentially that of the cylindrically walled rotary grinding drum, and a further proximate step portion having a diameter essentially that of the cylindrically walled rotary grinding drum reduced by the thickness of the peripheral cover plate and having a plurality of boreholes radially arranged in the peripheral surface of said step portion to receive a securing member, such as a flat head screw, to secure said peripheral cover plate to the outer supporting disks, each supporting disk between the end supporting disks has a diameter essentially that of the cylindrically walled rotary grinding drum reduced by the thickness of the peripheral cover plate and each such disk has a plurality of boreholes radially arranged in its generally annular peripheral surface to receive a securing member, such as a flat head screw, to secure said peripheral cover plate to the outer supporting disks;

c. the means for mounting the cylindrically walled rotary grinding drum such that the cylindrically walled rotary grinding drum can rotate in said stator comprises:

(1) an annular collar secured externally to each of the respective stator end walls and arranged coaxially with the aperture therein, and said annular collar having a plurality of internally threated boreholes, each arranged to receive a bearing cover securing bolt, each such annular collar having two substantially identical mating half collars with parallel flanges having at least one mating borehole arranged therein to receive a securing member such as a mating nut and bolt, each such half collar positioned on a respective upper and lower stator end wall section, and each such half collar arranged and adapted to be joined together as the upper and lower sections of the stator casing are mated together with the means for attaching the upper section of the stator casing to the lower section thereof;

said means for mounting the cylindrically walled rotary grinding drum such that the cylindrically walled rotary grinding drum can rotate in said stator further comprises, for each end of the shaft:

(2) at least one dirt ring arranged and adapted to be mounted in the annular wall dirt ring recess of each one of the stator end walls, (3) a seal, (4) a bearing seal locking plate axially abutting a bearing, (5) a bearing, (6) a bearing seal, (7) a bearing cover having a plurality of boreholes, each arranged to receive a bearing cover securing bolt, (8) a plurality of bearing cover securing bolts, (9) a threaded bearing locking member, such as a lock washer, having at least one transverse set screw,

(10) a shaft end cap having a central bore to accept a securing member, such as a screw,

(11) a threaded screw positioned in the central axially internally threaded bore in the end of each end of the shaft, whereby, in combination with said shaft, the threaded screw secures said shaft end cap which secures said the threaded lock washer which secures the bearing axially and the plurality of bearing cover securing bolts secure the bearing cover to the annular collar to secure the bearing radially which in combination secures the shaft radially and axially;

d. the drive means for rotating the cylindrically walled rotary grinding drum comprises:

(1) a suitably sized drive wheel, having a centrally located axial bore suitably sized to fit the drive end of the shaft with an offset keyway extending axially along a surface of said bore, positioned on the drive end of the shaft, and a suitably sized and adapted key positioned therein keying said drive wheel thereto, (2) a variable speed motor having a shaft mounted motor drive wheel, and (3) a means for connecting the motor drive wheel to the drive wheel of the shaft of the cylindrically walled rotary grinding drum so as said cylindrically walled rotary grinding drum can rotate between 50 and 350 rpm.

9. The comminuting device of claim 5, in which each of the drum cutting assembly comprises:

a. the drum elongated holder means having a drum elongated split holder casing with an upper and a lower section mateable along a generally horizontal plane, each such section having a generally a parallel congruent bottom wall and a plurality of transverse concentric boreholes suitably sized and adapted to accept a securing member, such as a threaded section mating bolt, with said upper section having a bore suitably sized to allow a bolt head to be recessed therein and with said lower section having an internally threaded bore suitably sized and adapted to engage the threads thereof, whereby, the respective upper and lower sections of the drum elongated split holder casing can be mated together to form the drum elongated holder means, (1) said upper section thereof having a bottom wall and a top wall parallel thereto, two parallel end walls, a rear wall, and a front wall, said bottom wall and said top wall each generally lying in a generally horizontal plane, ,said rear wall extending transversely upward and said end walls each extending upwardly from and having their bottom edges connected to the rear and side edges, respectively, of the bottom wall, said rear wall having its side edges connected to the rear side edges, respectively, of the end walls, said top wall having its side edges connected to the top edges of the end walls, respectively, its rear edge to the rear wall, and its front edge to the front wall, said front wall further having its lower edge connected to the front edge of the bottom wall and its side edges, respectively, to the side edges of the end walls, (2) said lower section thereof having a longitudinal recess positioned along the upper front corner thereof suitably sized and adapted for positioning the drum cutting teeth therein, said lower section thereof further comprising a bottom wall, two parallel end walls, each having a bottom edge, a rear side edge, a front side edge, a top edge, a recess side edge and a recess bottom edge, a rear wall, a front wall, a top wall, a recess bottom wall and a recess rear wall, said bottom wall, recess bottom wall and top wall each lie generally horizontal plane, said rear, front and end walls each extending upwardly from and having their bottom edges connected to the rear, front and side edges, respectively, of the bottom wall, said rear wall having its side edges connected to the rear side edges, respectively, of the end walls, said top wall having its side edges connected to the top edges of the end walls, respectively, its rear edge to the upper edge of the rear wall, and its front edge to the upper edge of the recess rear wall, said recess rear wall having its lower edge connected to the rear edge of the recess bottom wall and its side edges, respectively, to the recess side edges of the end walls, said recess bottom wall having its front edge connected to the upper edge of the front wall, its side edges, respectively, to the recess side edges of the end walls, and said front wall having its side edges connected, respectively, to front side edges of the end walls, said lower section thereof further comprising a plurality of boreholes transverse to the front wall thereof, suitably sized and adapted to accept a drum securing member, such as a threaded drum bolt, each such borehole having a bore suitably sized to allow a bolt head to be recessed therein as the threaded section of said bolt protrudes from the back wall thereof and engages the recess having a radially internally threaded bore to secure a threaded bolt on the annular surface of a supporting disk of the cylindrically walled rotary grinding drum, said lower section thereof further comprising a plurality of bores in the recess bottom wall, each suitably sized and adapted to accept a tooth retraining pin, and further arranged and adapted to position a drum cutting tooth having a central bore suitably sized and adapted to accept said tooth retraining pin to expose its drum cutting tip portion from the outwardly disposed face of said drum elongated holder means, (3) a plurality of threaded section mating bolts, (4) a plurality of tooth restraining pins, (5) a plurality of threaded drum bolts, to secure the drum cutting assembly to the drum;

b. the plurality of drum cutting teeth, each having a central bore suitably sized and adapted to accept a tooth retraining pin and further comprising a prism having at least three side walls, and two parallel congruent top and bottom walls, as said bottom wall and said top wall are each oriented to lie in a horizontal plane, each said side wall extending upwardly from and having its bottom edge connected to a side edge, respectively, of the bottom wall, each side wall having two side edges, each connected to a different side wall, said top wall having its side edges connected to the top edges of the side walls, each drum cutting tooth having an upwardly extending dimension of a side wall not exceeding the upwardly extending dimension of the recess rear wall of the drum elongated split holder casing.

10. The comminuting device of claim 8, in which at least one of the drum cutting assembly comprises:

a. the drum elongated holder means having a drum elongated split holder casing with an upper and a lower section mateable along a plane generally oblique to axis of the cylindrically walled rotary grinding drum, each such section having a generally parallel congruent bottom wall and a plurality of transverse concentric boreholes suitably sized and adapted to accept a securing member, such as a threaded section mating bolt, with said upper section having a bore suitably sized to allow a bolt head to be recessed therein and with said lower section having an internally threaded bore suitably sized and adapted to engage the threads thereof, whereby, the respective upper and lower sections of the drum elongated split holder casing can be mated together to form the drum elongated holder means, (1) said upper section thereof having a bottom wall and a top wall parallel thereto, two parallel end walls, a rear wall, and a helical ribbon shaped front wall, said bottom wall and said top wall each generally lying in a plane oblique to axis of the cylindrically walled rotary grinding drum, said rear wall extending transversely upward and said end walls each extending upwardly from and having their bottom edges connected to the rear and side edges, respectively, of the bottom wall, said rear wall having its side edges connected to the rear side edges, respectively, of the end walls, said top wall having its side edges connected to the top edges of the end walls, respectively, its rear edge to the rear wall, and its front edge to the front wall, said front wall further having its lower edge connected to the front edge of the bottom wall and its side edges, respectively, to the side edges of the end walls, (2) said lower section thereof having a longitudinal recess positioned along the upper front corner thereof suitably sized and adapted for positioning the drum cutting teeth therein, said lower section thereof further comprising a bottom wall, two parallel end walls, each having a bottom edge, a rear side edge, a front side edge, a top edge, a recess side edge and a recess bottom edge, a rear wall, a helical ribbon shaped front wall, a top wall, a recess bottom wall and a recess rear wall, said bottom wall, recess bottom wall and top wall each generally lying in a plane oblique to axis of the cylindrically walled rotary grinding drum, said rear, front and end walls each extending upwardly from and having their bottom edges connected to the rear, front and side edges, respectively, of the bottom wall, said rear wall having its side edges connected to the rear side edges, respectively, of the end walls, said top wall having its side edges connected to the top edges of the end walls, respectively, its rear edge to the upper edge of the rear wall, and its front edge to the upper edge of the recess rear wall, said recess rear wall having its lower edge connected to the rear edge of the recess bottom wall and its side edges, respectively, to the recess side edges of the end walls, said recess bottom wall having its front edge connected to the upper edge of the front wall, its side edges, respectively, to the recess side edges of the end walls, and said front wall having its side edges connected, respectively, to front side edges of the end walls, said lower section thereof further comprising a plurality of boreholes transverse to the front wall thereof, suitably sized and adapted to accept a drum securing member, such as a threaded drum bolt, each such borehole having a bore suitably sized to allow a bolt head to be recessed therein as the threaded section of said bolt protrudes from the back wall thereof and engages the recess having a radially internally threaded bore to secure a threaded bolt on the annular surface of a supporting disk of the cylindrically walled rotary grinding drum, said lower section thereof further comprising a plurality of bores in the recess bottom wall, each suitably sized and adapted to accept a tooth retraining pin, and further arranged and adapted to position a drum cutting tooth having a central bore suitably sized and adapted to accept said tooth retraining pin to expose its drum cutting tip portion from the outwardly disposed face of said drum elongated holder means, (3) a plurality of threaded section mating bolts, (4) a plurality of moth restraining pins, (5) a plurality of threaded drum bolts, to secure the drum cutting assembly to the drum;

b. the plurality of drum cutting teeth, each having a central bore suitably sized and adapted to accept a tooth retraining pin and further comprising a prism having at least three side walls, and two parallel congruent top and bottom walls, as said bottom wall and said top wall are each oriented to lie in a horizontal plane, each said side wall extending upwardly from and having its bottom edge connected to a side edge, respectively, of the bottom wall, each side wall having two side edges, each connected to a different side wall, said top wall having its side edges connected to the top edges of the side walls, each drum cutting tooth having an upwardly extending dimension of a side wall not exceeding the upwardly extending dimension of the recess rear wall of the drum elongated split holder casing.

11. The comminuting device of claim 10, in which each stator cutting assembly comprises:

a. the stationary elongated holder means having a stationary elongated split holder casing with an upper and a lower section mateable along a generally horizontal plane, each such section having a generally parallel congruent bottom wall and a plurality of concentric vertical boreholes suitably sized and adapted to accept a securing member, such as a threaded section mating bolt, with said upper section having a bore suitably sized to allow a bolt head to be recessed therein and with said lower section having an internally threaded bore suitably sized and adapted to engage the threads thereof, whereby, the respective upper and lower sections of the stationary elongated split holder casing can be mated together to form the stationary elongated holder means, (1) said upper section thereof further comprising a prism having a bottom wall, two parallel congruent end walls, each having a bottom edge, two side edges, a top edge and a side diagonal edge, a rear wall, a top wall and a top diagonal wall, said top diagonal wall having an upper rear edge, two side edges and a lower front edge, said bottom wall and said top wall each generally lying in a horizontal plane, said rear and end walls each extending upwardly from and having their bottom edges connected to the rear and side edges, respectively, of the bottom wall, said rear wall having its side edges connected to the rear side edges, respectively, of the end walls, said top wall having its side edges connected to the top edges of the end walls, respectively, its rear edge to the rear wall, and its front edge to the upper rear edge of the top diagonal wall, said top diagonal wall further having its lower front edge connected to the front edge of the bottom wall and its side edges, respectively, to the side diagonal edges of the end walls, (2) said lower section thereof comprising a square prism having an longitudinal recess positioned along the upper front comer thereof suitably sized and adapted for positioning the stator cutting teeth therein, said lower section thereof further comprising a bottom wall, two parallel congruent end walls, each having a bottom edge, a rear side edge, a front side edge, a top edge, a recess side edge and a recess bottom edge, a rear wall, a front wall, a top wall, a recess bottom wall and a recess rear wall, said bottom wall, recess bottom wall and top wall each generally lying in a horizontal plane, said rear, front and end walls each extending upwardly from and having their bottom edges connected to the rear, front and side edges, respectively, of the bottom wall, said rear wall having its side edges connected to the rear side edges, respectively, of the end walls, said top wall having its side edges connected to the top edges of the end walls, respectively, its rear edge to the upper edge of the rear wall, and its front edge to the upper edge of the recess rear wall, said recess rear wall having its lower edge connected to the rear edge of the recess bottom wall and its side edges, respectively, to the recess side edges of the end walls, said recess bottom wall having its front edge connected to the upper edge of the front wall, its side edges, respectively, to the recess side edges of the end walls, and said front wall having its side edges connected, respectively, to front side edges of the end walls, said lower section thereof further comprising a plurality of horizontal boreholes suitably sized and adapted to accept a stator securing member, such as the end of a threaded stator bolt, to secure the stationary elongated holder means to the inner wall section of the stator;

said lower section thereof further comprising a plurality of vertical bores in the recess bottom wall, each suitably sized and adapted to accept a tooth retraining pin, and further arranged and adapted to position a stator cutting tooth having a central bore suitably sized and adapted to accept said tooth retraining pin to expose its stator cutting tip portion from the outwardly disposed face of said stationary drum elongated holder means, (3) a plurality of threaded section mating bolts, (4) a plurality of tooth restraining pins, (5) a plurality of threaded stator bolts, to secure the stator cutting assembly to the stator;

b. the plurality of stator cutting teeth, each having a central bore suitably sized and adapted to accept a tooth retraining pin andfurther comprising a prism having at least three side walls, and two parallel congruent top and bottom walls, when said bottom wall and said top wall are each oriented to lie in a horizontal plane, each said side wall extending upwardly from and having its bottom edge connected to a side edge, respectively, of the bottom wall, each side wall having two side edges, each connected to a different side wall, said top wall having its side edges connected to the top edges of the side walls, each stator cutting tooth having an upwardly extending dimension of a side wall not exceeding the upwardly extending dimension of the recess rear wall of the stationary elongated split holder casing.

12. The comminuting device of claim 11, further comprising, a. for each drum cutting assembly and each stator cutting assembly (1) cutting teeth which are identically shaped, (2) each drum cutting tip portion and each stator cutting tip portion having tip angle $\alpha$, which angle does not exceed 90°, defined by the angle between the side walls of said cutting tip portion exposed from the outwardly disposed face of the drum and stator elongated holder means, respectively, (3) each such cutting tooth having a distance between the center of its central bore and its cutting tip equal to (4) each drum cutting tooth and each stator cutting tooth, each having an upwardly extending dimension of its side wall $\infty$, which is sufficiently less than the upwardly extending dimension of the recess rear wall, respectively, of the drum elongated split holder casing and the stator elongated split holder casing, to allow rotating movement of each tooth about its tooth restraining pin upon impact with work material passing therebetween, (5) the recess rear wall of the respective elongated split holder casings is arranged and adapted to restrict the rotating movement of each tooth about its tooth restraining pin to an angle not exceeding $(45°-\frac{1}{2}\alpha)$ in either direction from a plane passing through such restraining pin and transverse to its elongated split holder casings;

b. the stator cutting tip portions being arranged in interpolative relation with said drum cutting tip portions as the cylindrically walled rotary grinding drum is rotated and having a minimum clearance $\Theta$, therebetween;

c. for each drum cutting assembly having an angle $\beta$, between a plane passing through the teeth of said drum cutting assembly and the horizontal plane;

d. the incremental axial expansion $\delta$ between adjacent cutting teeth on the cylindrically walled rotary grind drum, whereby, the distance $\Sigma$ between the central bores of adjacent teeth on the stator is approximated by a trigonometric equation $$\Sigma=4\Phi\sin(45°-\tfrac{1}{2}\alpha)+\infty\tan\beta+2\Theta+\delta$$

13. The comminuting device of claim 12, wherein:

a. the top and bottom walls of each cutting tooth, each essentially comprise an equilateral triangle;

b. the recess rear wall of the longitudinal recess of the lower section of the drum elongated holder means has a generally congruent surface to the helical ribbon shaped front wall thereof;

c. the recess rear wall of the longitudinal recess of the lower section of the stator elongated holder means has a generally flat surface parallel to the front wall thereof, whereby, the transverse distance $\Gamma$ between the central bore of each cutting tooth and the recess rear wall of the longitudinal recess is approximated by a trigonometric equation $$\Gamma=\Phi\div(\sqrt{2}).$$

14. The comminuting device of claim 12, further comprising two stator cutting assemblies, each arranged and adapted to position the recess bottom wall of the lower section of the stationary elongated split holder casing along a generally horizontal plane passing through axis of the cylindrically walled rotary grinding drum.

15. The comminuting device of claim 14, wherein a. the position of the stator cutting teeth in one stationary elongated holder means are transversely offset in relation to the position of the stator cutting teeth in the other;

b. each of the drum cutting teeth in each drum cutting assembly having an angle $\beta$, between the plane passing through the teeth of said drum cutting assembly and the horizontal plane, exposes a drum cutting tip portion having a top and a bottom wall at an oblique angle $\beta$ to the horizontal plane, each of said cutting tip portions further comprises a portion of two side walls, a leading edge comprises an intersection of each side wall of said cutting tip portion with an edge of the top wall, a leading edge further comprises an intersection of each side wall of said cutting tip portion with an edge of the bottom wall;

c. an interpolative cutting edge comprises the leading edge on a drum cutting tip portion first entering the plane of the stator cutting teeth in one stationary elongated holder means relative to the other leading edges on said cutting tip portion;

d. each said interpolative cutting edge of a drum cutting tip portion is arranged and adapted to interpolatively engage a stator cutting tooth in each of the stationary elongated holder means.

16. The comminuting device of claim 15, wherein a. the cylindrically walled rotary grinding drum comprises seven drum cutting assemblies disposed along the peripheral surface thereof, at least six of which have an angle $\beta$, between the plane passing through the teeth of said drum cutting assemblies and the horizontal plane;

b. only one interpolative cutting edge interpolatively engages a stator cutting tooth at any moment during rotation.

17. A comminuting device as in claim 16, in which a. the inner wall section of the stator further comprises:

(1) at least one elongated foraminated screen forming a semicircular ring sector generally positioned below and concentric with said cylindrically walled rotary grinding drum, each said elongated foraminated screen having generally horizontally disposed flanges extending from the longitudinal ends thereof, each said horizontally disposed flange arranged and adapted to be secured to the means for housing the cylindrically walled rotary grinding drum casing;

(2) said means for housing the cylindrically walled rotary grinding drum further comprising a curved screen access door generally with curved lateral ends positioned generally concentrically with and below the elongated foraminated screen and having its lateral ends in engaging contact with the means for housing the cylindrically walled rotary grinding drum when said door is in a closed position, said screen access door hingedly connected to and having a horizontal hinge and a means to secure said screen access door, such as a pivotal bolt, said screen access door operating between a raised position during operation wherein said means to secure said screen access door is employed and said door is closed, and a lowered position for access to the elongated foraminated screen, said screen door further having a passageway positioned below and in communication with the screen through which comminuted work material may pass;

b. the means for allowing work material and process air into and out of a region between the cylindrically grinding drum and said stator further comprises:

(1) a discharge duct mountingly disposed below and in communication with the passageway of the screen door, said discharge duct having at one end thereof an adjustable air inlet gate to regulate the flow of process air, a means to disconnect said discharge duct from a blower, and a motorized blower to discharge comminuted work material, (2) an air control damper in the means for housing the cylindrically walled rotary grinding drum having an elongated opening and an adjustable cover plate therefor, to regulate the inflow of process air;

c. a rigid base is arranged and adapted to support said comminuting device at sufficient elevation above floor grade to permit the screen door, with the discharge duct mounted thereto, to be moved from a raised position to a lowered position.

18. The comminuting device of claim 11, further comprising, a. for each drum cutting assembly and each stator cutting assembly (1) cutting teeth which are identically shaped, (2) each drum cutting tip portion and each stator cutting tip portion having tip angle $\alpha$, which angle does not exceed 90°, defined by the angle between the side walls of said cutting tip portion exposed from the outwardly disposed face of the drum and stator elongated holder means, respectively, (3) each such cutting tooth having a distance between the center of its central bore and its cutting tip equal to $\Phi$, (4) each drum cutting tooth and each stator cutting tooth, each having an upwardly extending dimension of its side wall $\infty$, which is sufficiently less than the upwardly extending dimension of the recess rear wall, respectively, of the drum elongated split holder casing and the stator elongated split holder casing, to allow rotating movement of each tooth about its tooth restraining pin upon impact with work material passing therebetween, (5) the recess rear wall of the respective elongated split holder casings is arranged and adapted to restrict the rotating movement of each tooth about its tooth restraining pin;

b. the stator cutting tip portions being arranged in interpolative relation with said drum cutting tip portions as the cylindrically walled rotary grinding drum is rotated and having a minimum clearance o, therebetween;

c. for each drum cutting assembly having an angle $\beta$, between a plane passing through the teeth of said drum cutting assembly and the horizontal plane;

d. the incremental axial expansion $\delta$ between adjacent cutting teeth on the cylindrically walled rotary grind drum, whereby, the distance $\Sigma$ between the central bores of adjacent teeth on the stator is approximated by a trigonometric equation $$\Sigma=4\Phi\sin(\tfrac{1}{2}\alpha)+\infty\tan\beta+2\Theta+\delta$$

19. The comminuting device of claim 11, wherein:

a. the recess rear wall of the longitudinal recess of the lower section of the drum elongated holder means has a generally congruent surface to the helical ribbon shaped front wall thereof;

b. the recess rear wall of the longitudinal recess of the lower section of the stator elongated holder means has a generally flat surface parallel to the front wall thereof;

c. for each drum cutting assembly and each stator cutting assembly, the top and bottom walls of each cutting tooth, each essentially comprisean equilateral triangle, (1) each drum cutting tooth and each stator cutting tooth, each having a distance between the center of its central bore and its cutting tip equal to $\Phi$, (2) each drum cutting tooth and each stator cutting tooth, each having an upwardly extending dimension of its side wall $\infty$, which is sufficiently less than the upwardly extending dimension of the recess rear wall, respectively, of the drum elongated split holder casing and the stator elongated split holder casing, to allow rotating movement of each tooth about its tooth restraining pin upon impact with work material passing therebetween, d. the recess rear wall of the respective elongated split holder casings is each arranged and adapted to restrict the rotating movement of each tooth about its tooth restraining pin, by adjusting the transverse distance between the central bore of each cutting tooth relative to the recess rear wall of the longitudinal recess.

20. A comminuting device as in any one of claims 1–15, 18, and 19, in which a. the inner wall section of the stator further comprises:

(1) at least one elongated foraminated screen forming a semi-circular ring sector generally positioned below and concentric with said cylindrically walled rotary grinding drum, each said elongated foraminated screen having generally horizontally disposed flanges extending from the longitudinal ends thereof, each said horizontally disposed flange arranged and adapted to be secured to the means for housing the cylindrically walled rotary grinding drum casing;

(2) said means for housing the cylindrically walled rotary grinding drum further comprising a curved screen access door generally with curved lateral ends positioned generally concentrically with and below the elongated foraminated screen and having its lateral ends in engaging contact with the means for housing the cylindrically walled rotary grinding drum when said door is in a closed position, said screen access door hingedly connected to and having a horizontal hinge and a means to secure said screen access door, such as a pivotal bolt, said screen access door operating between a raised position during operation wherein said means to secure said screen access door is employed and said door is closed, and a lowered position for access to the elongated foraminated screen, said screen door further having a passageway positioned below and in communication with the screen through which comminuted work material may pass;

b. the means for allowing work material and process air into and out of a region between the cylindrically grinding drum and said stator further comprises:

(1) a discharge duct mountingly disposed below and in communication with the passageway of the screen door, said discharge duct having at one end thereof an adjustable air inlet gate to regulate the flow of process air, a means to disconnect said discharge duct from a blower, and a motorized blower to discharge comminuted work material, (2) an air control damper in the means for housing the cylindrically walled rotary grinding drum having an elongated opening and an adjustable cover plate therefor, to regulate the inflow of process air;

c. a rigid base is arranged and adapted to support said comminuting device at sufficient elevation above floor grade to permit the screen door, with the discharge duct mounted thereto, to be moved from a raised position to a lowered position.

21. A comminuting device as in any one of claims 1–19, in which:

a. the means for allowing work material and process air into and out of a region between the cylindrically grinding drum and said stator further comprises:

(1) an elongated opening positioned in the means for housing the cylindrically walled rotary grinding drum parallel to the axis of the cylindrically walled rotary grinding drum;

b. the means for housing the cylindrically walled rotary grinding drum further comprises a material feed hopper tandemly disposed above and mounted on the means for housing the cylindrically walled rotary grinding drum, (1) said material feed hopper having an elongated opening at the top for receiving material to be comminuted, upright end walls downwardly tapering, and a bottom opening that is directly overlying, parallel to and in communication with the elongated opening positioned in the means for housing the cylindrically walled rotary grinding drum, (2) said material feed hopper having disposed in a bottom portion thereof an elongated rotary feeder having an externally disposed variable speed motor connected thereto;

said rotary feeder having a substantially cylindrical drum with a plurality of paddles disposed along the surface thereof and having an axis parallel to and positioned above said bottom opening of said material feed hopper;

the cylindrical drum of the rotary feeder, the bottom opening of the material feed hopper, and the elongated opening positioned in the means for housing the cylindrically walled rotary grinding drum, each having a length approximating the length of that portion of the cylindrically walled rotary grinding drum having a drum cutting assembly disposed thereon, such that the work materials may be fed along the entire length thereof to equalize the load on the drum cutting teeth;

c. said comminuting device further comprising a load monitor for the motor driving the cylindrically walled rotary grinding drum which adjusts the power supplied to the motor for the rotary feeder to coordinate work material throughput;

d. the process air is controlled by automatic dampers connected to a controller;

e. the feeder is adjustably mounted so that it may be re-positioned for various sizes of work material;

f. said comminuting device further comprising a manual override to reverse the normal rotation of the cylindrically walled rotary grinding drum is provided.

* * * * *

UNITED STATES PATENT AND TRADEMARK OFFICE

CERTIFICATE OF CORRECTION

PATENT NO. : 5,402,948

DATED : April 4, 1995

INVENTOR(S) : Kaczmarek

It is certified that error appears in the above-identified patent and that said Letters Patent is hereby corrected as shown below:

Title Page [54], (Title), after "Comminuting Device" delete "With Face".

Title Page [63], Related U.S. Application Data --Continuation-in-part of Ser. No. PCT/US/93/01555, Feb. 19, 1993 --.

Column 1, line 45 after "the", delete "dram", and insert -- drum --.

Column 2, line 19, after "that it", insert -- is --.

Column 3, line 46, after "then be", delete "discharge," and insert -- discharged --;

Column 3, line 52, after "been", delete "outline", and insert -- outlined --.

Column 4, line 49, after "a drum", delete "cuting", and insert -- cutting --;

Column 4, after "Fig. 14", delete "."

Column 6, line 65, after "for activation by", delete "an by".

UNITED STATES PATENT AND TRADEMARK OFFICE

CERTIFICATE OF CORRECTION

PATENT NO. : 5,402,948

DATED : April 4, 1995

INVENTOR(S) : Kaczmarek

It is certified that error appears in the above-identified patent and that said Letters Patent is hereby corrected as shown below:

Column 7, line 20, after "that the," delete "an";

Column 7, line 23, after "that the", delete "an".

Column 8, line 29, after "generally", delete "a";

Column 8, line 67, delete "comer", and insert -- corner --.

Column 9, line 37, after "The", delete "moth", and insert -- tooth --;

Column 9, line 66, after "generally", delete "a".

Column 11, line 1, after "tooth", delete "retraining", and insert -- restraining --;

Column 11, line 14, delete "tance", and insert -- tant --.

Column 12, line 55, delete "101" and insert -- Φ --.

Column 14, line 8, after "portion" delete "14 1", and insert -- 141 --.

Column 15, line 23, delete "FIGS" and insert -- FIG --;

Column 15, line 46, after "internally" delete "threated", and insert -- threaded --.

Column 15, line 68, after "abutting a", delete "heating", and insert -- bearing --.

UNITED STATES PATENT AND TRADEMARK OFFICE

CERTIFICATE OF CORRECTION

PATENT NO. : 5,402,948

DATED : April 4, 1995

INVENTOR(S) : Kaczmarek

It is certified that error appears in the above-identified patent and that said Letters Patent is hereby corrected as shown below:

Column 16, line 9, delete "beating" , and insert -- bearing --;

Column 16, line 10, after "integral", delete "fibs", and insert -- ribs;

Column 16, line 29, after "which secures", delete "said the", and insert -- the said --.

Column 17, line 23, after "manually", delete "adjustment", and insert -- adjust --.

Column 18, line 25, after "passing", insert -- blank space --;

Column 18, line 39, after "generally", insert -- blank space --.

Column 19, line 33, after "journal", delete "beating" and insert -- bearing --.

Column 20, line 62, delete "threated", and insert -- threaded --.

Column 21, line 12, after "shaft", delete ":", and insert -- ; --;

Column 21, line 35, after "said", delete "the";

Column 21, line 62, after "having a generally", delete "a".

Column 22, line 11, after "horizontal plane,", delete ",".

Column 23, line 3, after "tooth", delete "retraining", and insert -- restraining --.

UNITED STATES PATENT AND TRADEMARK OFFICE

CERTIFICATE OF CORRECTION

PATENT NO. : 5,402,948

DATED : April 4, 1995

INVENTOR(S) : Kaczmarek

It is certified that error appears in the above-identified patent and that said Letters Patent is hereby corrected as shown below:

Column 23, line 7, after "tooth", delete "retraining" and insert -- restraining --.

Column 24, line 51, after "tooth" delete "retraining", and insert -- restraining --;

Column 24, line 55, after "tooth" delete "retraining", and insert -- restraining --;

Column 24, line 59, after "plurality of", delete "moth", and insert -- tooth --;

Column 24, line 64, after "tooth", delete "retraining", and insert -- restraining --.

Column 25, line 55, after "front", delete "comer", and insert -- corner --.

Column 26, line 27, after "tooth", delete "retraining" and insert -- restraining --;

Column 26, line 30, after "tooth", delete "retraining" and insert -- restraining --.

Column 26, line 36, after "tooth", delete "retraining" and insert -- restraining --;

Column 26, line 39, after "and", insert -- blank space --.

UNITED STATES PATENT AND TRADEMARK OFFICE

CERTIFICATE OF CORRECTION

PATENT NO. : 5,402,948

DATED : April 4, 1995

INVENTOR(S) : Kaczmarek

It is certified that error appears in the above-identified patent and that said Letters Patent is hereby corrected as shown below:

Column 26, line 60, after "assembly", insert -- : --.

Column 27, line 3, after "equal to", insert -- $\Phi$ --;

Column 27, line 36, at the end of the equation insert -- . --.

Column 27, line 61, after "wherein", insert -- : --.

Column 28, line 21, after "wherein", insert -- : --.

Column 29, line 53, after "clearance", delete "0" and insert -- $\Theta$ --.

Column 29, line 40, after "rotary", delete "grind", and insert -- grinding --;

Column 29, line 64, at the end of the equation add -- . --.

Column 30, line 9, delete "comprisean", and insert -- comprise an --.

Signed and Sealed this

Seventeenth Day of October, 1995

*Attest:*

Bruce Lehman

BRUCE LEHMAN

*Attesting Officer*

*Commissioner of Patents and Trademarks*